US009683383B2

(12) United States Patent
Shlomi-Shlomi et al.

(10) Patent No.: US 9,683,383 B2
(45) Date of Patent: Jun. 20, 2017

(54) POOL CLEANING APPARATUS

(71) Applicant: MAYTRONICS LTD., Kibutz Yizrael (IL)

(72) Inventors: Idan Shlomi-Shlomi, Mitzpe Aviv (IL); Igor Grubman, Haifa (IL)

(73) Assignee: MAYTRONICS LTD., Kibbutz Yizrael (IL)

( * ) Notice: Subject to any disclaimer, the term of this patent is extended or adjusted under 35 U.S.C. 154(b) by 36 days.

(21) Appl. No.: 14/740,285

(22) Filed: Jun. 16, 2015

(65) Prior Publication Data

US 2015/0337556 A1 Nov. 26, 2015

Related U.S. Application Data

(63) Continuation of application No. 14/023,557, filed on Sep. 11, 2013, now Pat. No. 9,328,525.

(30) Foreign Application Priority Data

Sep. 11, 2012 (IL) ..... 221876

(51) Int. Cl.
*E04H 4/16* (2006.01)
*E04H 4/12* (2006.01)

(52) U.S. Cl.
CPC ..... *E04H 4/1663* (2013.01); *E04H 4/1209* (2013.01); *E04H 4/1654* (2013.01)

(58) Field of Classification Search
CPC .... E04H 4/1663; E04H 4/1209; E04H 4/1655
USPC ..... 210/167.16, 167.17, 411, 416.1, 416.2; 15/1.7
See application file for complete search history.

(56) References Cited

U.S. PATENT DOCUMENTS

| | | | |
|---|---|---|---|
| 3,961,393 | A | 6/1976 | Pansini |
| 5,028,321 | A | 7/1991 | Stone |
| 6,473,927 | B1 | 11/2002 | Sommer |
| 8,869,337 | B2 | 10/2014 | Sumonthee |
| 2003/0132152 | A1 | 7/2003 | Illingworth |
| 2006/0021922 | A1* | 2/2006 | Lamberts Van Assche ..... B01D 24/14 210/167.13 |
| 2008/0235887 | A1 | 10/2008 | Horvath |

* cited by examiner

*Primary Examiner* — Fred Prince
(74) *Attorney, Agent, or Firm* — Reches Patents

(57) ABSTRACT

A pool cleaning robot, that may include a filter; a first impeller; a driving unit arranged to move the pool cleaning robot; an external housing that comprises a first inlet and a first outlet; a first pump motor arranged to rotate the first impeller; wherein when the first pump motor rotates the first impeller rotates along a first rotational direction causes fluid to be drawn through the first inlet and causes a first portion of the fluid to be filtered by the filter to provide filtered fluid that exits through the first outlet of the housing; wherein when the first pump motor rotates the first impeller rotates along a second rotational direction that is opposite to the first rotational direction, thereby performing a backwash operation of the filter.

38 Claims, 26 Drawing Sheets

10

10

10

10

10

10

1000

900

POOL CLEANING APPARATUS

CROSS REFERENCE TO RELATED APPLICATIONS

This patent application is a continuation of U.S. patent application Ser. No. 14/023,557 filing date Sep. 11, 2013 which claims priority from Israeli patent application serial number 221876 filing date Sep. 11, 2012, all being incorporated herein by reference.

BACKGROUND

Pool cleaning apparatuses are known in the art. Various pool cleaning apparatuses are manufactured by Maytronics Ltd. of Israel and represent the state of the art of pool cleaning apparatuses.

A pool cleaning apparatus is expected to clean the pool by filtering the fluid of the pool and removing foreign particles from that fluid. Such foreign particles tend to aggregate within the pool cleaning apparatus and may eventually substantially reduce the filtering capabilities of the pool cleaning apparatus.

There is a growing need to provide an efficient pool cleaning apparatus that can maintain a reasonable filtering capability during long periods.

SUMMARY

According to an embodiment of the invention there may be provided a pool cleaning robot that may include a filter; a first impeller; a driving unit arranged to move the pool cleaning robot; an external housing that may include a first inlet and a first outlet; a first pump motor arranged to rotate the first impeller; wherein when the first pump motor rotates the first impeller rotates along a first rotational direction causes fluid to be drawn through the first inlet and causes a first portion of the fluid to be filtered by the filter to provide filtered fluid that exits through the first outlet of the housing; wherein when the first pump motor rotates the first impeller rotates along a second rotational direction that may be opposite to the first rotational direction, thereby performing a backwash operation of the filter.

The pool cleaning robot may include a structural element; and wherein the filter and the structural element define a first space that has a spiral portion; wherein when the first pump motor rotates the first impeller along the first rotational direction the fluid follows a spiral path within the first space during which the first portion of the fluid may be filtered by the filter.

The pool cleaning robot may include a second impeller; wherein when the first impeller may be rotated along the second rotational direction the second impeller may be stationary.

The pool cleaning robot may include a second impeller; wherein when the first impeller may be rotated along the second rotational direction the second impeller rotates along the second rotational direction.

The pool cleaning robot may include a second impeller and a second pump motor arranged to rotate the second impeller; wherein the controller arranged to control the first and second pump motors so that the first and second impellers may be arranged to operate in at least three modes out of: a first mode during which the first and second impellers rotate about the first rotational direction and at a same speed; a second mode during which the first and second impellers rotate about the first rotational direction while one impeller of the first and second impellers rotates at a lower speed than another impeller of the first and second impellers; a third mode during which one impeller of the first and second impeller rotates about the first rotational direction at a speed that may be higher than a speed of another impeller of the first and second impeller that rotates about the second rotational direction; and a fourth mode during which the first and second impellers rotates about the second rotational direction.

The first pump motor may be arranged to rotate the first impeller along the first rotational direction during a filtering period and may be arranged to rotate the first impeller rotates along the second rotational direction during a backwash period; wherein the backwash period may be shorter than the filtering period.

The backwash period may be less than five seconds and the filtering period may exceed a minute.

The pool cleaning robot may include a uni-directional valve for reducing an amount of dirt exited from the pool cleaning robot as a result of the backwash of the filter.

The pool cleaning robot may include a movable flap for reducing an amount of dirt exited from the pool cleaning robot as a result of the backwash of the filter.

The pool cleaning robot may include an entrapment cell; wherein when the first pump motor rotates the first impeller along the first rotational direction a second portion of the fluid enters the entrapment cell; wherein the second portion of the fluid conveys particles that did not pass through the filter.

The at least some of the particles conveyed by the second portion of the fluid may be too big to be filtered by the filter.

The entrapment cell may be arranged to return at least some of the second portion of the fluid to the first space.

The pool cleaning robot may include a structural element; wherein the structural element may include a wall and a spiral guide that may be coupled to the wall.

The wall may include at least one opening that facilitates an exchange of fluid between the first space and the entrapment cell.

The wall and the filter have a radial symmetry in relation to a vertical axis.

The first inlet has a first movable flap that may be arranged to move between an inlet closing position and a fluid directing position.

The first movable flap, when positioned at the fluid directing position, may be arranged to direct the fluid towards the spiral guide.

The first movable flap may be arranged to move to the fluid directing position due to the rotation of the first impeller along the first rotational direction.

The first movable flap, when positioned at the inlet closing position, may be arranged to prevent particles to exit the pool cleaning robot.

The external housing may include multiple inlets that may be located between the filter and the wall; and wherein each may be proximate to a movable flap; wherein the multiple inlets may include the first inlet.

The multiple inlets may be formed within a ring shaped portion of a bottom panel of the housing, wherein the ring shape portion may be delimited by the filter and the wall.

The each movable flap, when positioned at a fluid directing position, directs the fluid towards the spiral guide.

The wall substantially surrounds the filter and wherein the filter substantially surrounds the first impeller.

The filter substantially surrounds the wall.

The pool cleaning robot may include an entrapment cell that has a first opening for receiving the second portion of fluid, the first opening may be at least partially defined by an upper rim of the wall.

The pool cleaning robot may include an entrapment cell and a fluid directing element that extends between the wall and the filter and arranged to direct fluid that reaches the end of the spiral path to enter the entrapment cell.

The first outlet may be preceded by a first fluid conduit that may be arranged to guide the filtered fluid from the first impeller towards the first outlet so that the filtered fluid exits the pool cleaning robot such as to induce motion of the pool cleaning robot along a first direction.

The housing may include a second outlet and wherein the pool cleaning robot may include a second impeller; wherein the second outlet may be preceded by a second fluid conduit that may be arranged to guide filtered fluid from the second impeller, wherein the second impeller rotates along the first rotational direction, towards the second outlet so that the filtered fluid exits the pool cleaning robot such as to induce motion of the pool cleaning robot along a second direction.

The second direction may differ from the first direction.

The each of the first and second impeller may be independently controllable.

The each of the first and second impellers may be located within a central segment of the pool cleaning robot the central segment being delimited by the filter, a bottom panel of the housing and an upper shell of the housing.

The filter may have a spiral shape.

The pool cleaning robot may include a filtering unit that may be detachably coupled to at least one other element of the filtering unit, the filtering unit may include the filter, an entrapment cell and a structural element.

The external housing may include an external cover that may be detachably coupled to an upper shell of the external housing.

A removal of the external cover may facilitate a removal of the filtering unit.

The filtering unit may include a first filtering unit inlet that has a first movable flap that may be arranged to move between an inlet closing position and a fluid directing position.

The pool cleaning robot may include an entrapment cell that may be configured to receive dirt resulting from the performing of the backwash operation of the filter.

The pool cleaning robot may include movable flaps that may be closed during the backwash operation of the filter.

Any combination of any components of any of the mentioned above pool cleaning apparatuses can be provided. Especially, the pool cleaning apparatus illustrated in the last paragraph can include any of the elements of any pool cleaning apparatuses described in preceding paragraph.

BRIEF DESCRIPTION OF THE DRAWINGS

The subject matter regarded as the invention is particularly pointed out and distinctly claimed in the concluding portion of the specification. The invention, however, both as to organization and method of operation, together with objects, features, and advantages thereof, may best be understood by reference to the following detailed description when read with the accompanying drawings in which:

Figure 1:
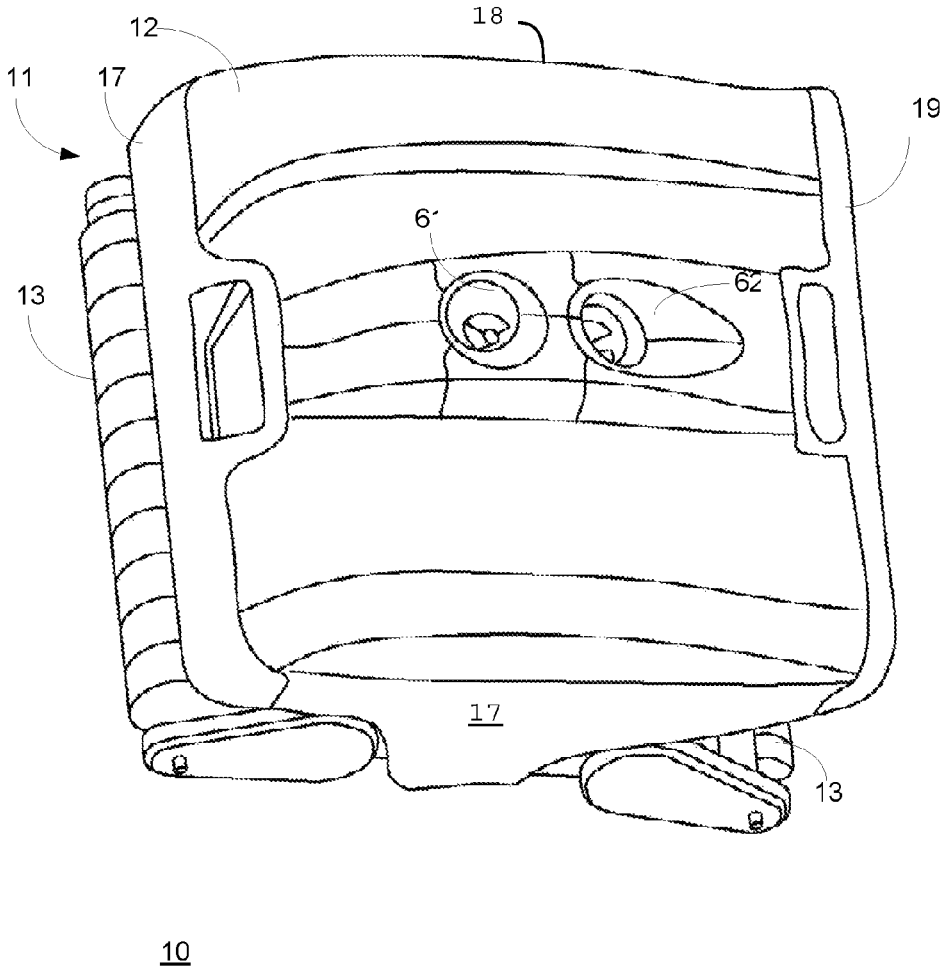
FIG. 1 illustrates a pool cleaning apparatus according to an embodiment of the invention.

It will be appreciated that for simplicity and clarity of illustration, elements shown in the figures have not necessarily been drawn to scale. For example, the dimensions of some of the elements may be exaggerated relative to other elements for clarity. Further, where considered appropriate, reference numerals may be repeated among the figures to indicate corresponding or analogous elements.

DETAILED DESCRIPTION OF THE PRESENT INVENTION

In the following detailed description, numerous specific details are set forth in order to provide a thorough understanding of the invention. However, it will be understood by those skilled in the art that the present invention may be practiced without these specific details. In other instances, well-known methods, procedures, and components have not been described in detail so as not to obscure the present invention.

The terms inlet is used to define openings or apertures that may act as inlets when the pool cleaning apparatus is in a certain operational mode (for example—when a certain impeller rotates about a first rotational direction). It is noted that the functionality of each outlet can be reversed and it may operate as an inlet—when the pool cleaning apparatus is in another operational mode (for example—when a certain impeller rotates about a second rotational direction that is opposite to the first rotational direction). The same applies mutatis mutandis to inlets—they may also function as inlets.

Although there is a reference to a pool cleaning apparatus it is noted that the pool cleaning apparatus can be arranged to clean any element that stores fluid.

There is provided a pool cleaning apparatus that is capable of filtering fluid while removing particles that can not pass through the filter to be aggregated in a entrapment cell that may be spaced apart from the filter—and thus reduce any clogging effect that particles can have on the filter.

The filtering process can be executed while the fluid follows a spiral path within a first space of the pool cleaning apparatus. A filter can define a part of that first space.

Figure 2:
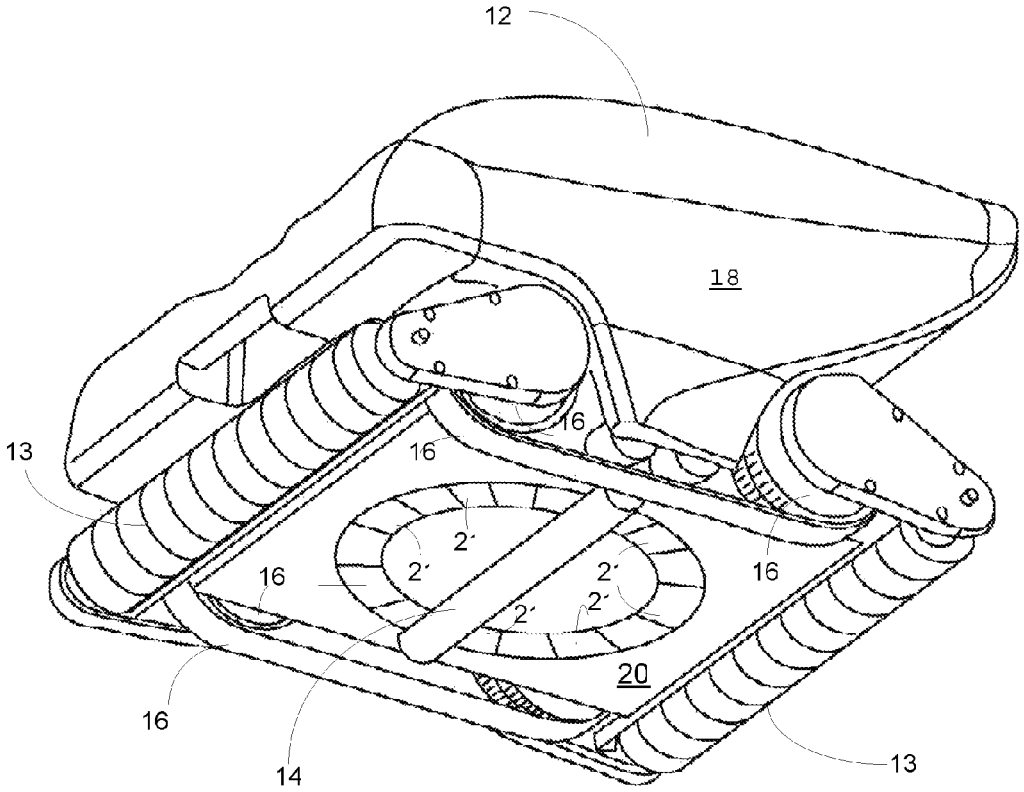
FIG. 2 illustrates a pool cleaning apparatus according to an embodiment of the invention.

The exterior of the pool cleaning apparatus is illustrated in FIGS. 1 and 2.

Figure 11:
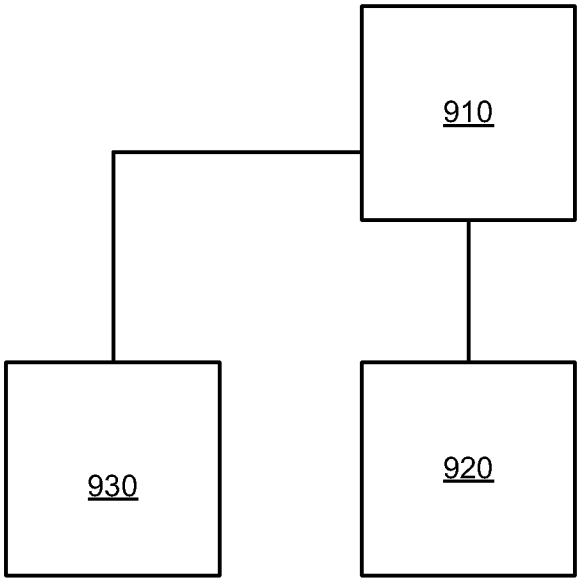
FIG. 11 illustrates a method according to an embodiment of the invention.

Pool cleaning apparatus 10 has an external housing 11 that surrounds various internal components, some being illustrated in FIGS. 1 and 11.

The external housing 11 may include one or more inlets and one or more outlets. Fluid can enter the external housing 11 through one or more inlets and exit through one or more outlets. It is noted that the direction of flow of the fluid can be determined by the rotational direction of one or more impellers of the pool cleaning apparatus and that changes in the direction of rotation of any of these impellers may cause an opening to turn from being an outlet to being an inlet. For simplicity of explanation an opening will be regarded as being an inlet if it allows fluid to enter the pool cleaning apparatus during filtering operation. The opening will be regarded as an outlet if it allows fluid to exit the pool cleaning apparatus during filtering operation.

FIG. 2 illustrates multiple inlets 22 that are formed in a bottom panel 20 of the external housing 11. The number of inlets 22 can range between one and more than ten. They can have the same shape and size but may differ from each other by shape or size or both.

The inlets 22 are illustrated as being formed within an annular space. This annular space can be defined by the lower portions of a filter 30 and a wall 40 (of FIGS. 3 and 4A)—both being internal components of the pool cleaning apparatus 10.

FIG. 2 also illustrates various components of a driving unit that arranged to move the pool cleaning apparatus. The various components include a track 16 that is rotated by rotating elements (not shown) and causes wheels 16' to rotate and thereby move the pool cleaning apparatus 10.

FIGS. 1 & 2 further illustrates cleaning elements such as front and rear brush wheels 13, and a intermediate brush 14, all being connected to pins or axes that in turn are connected to the external housing 11 or to other parts of the pool cleaning apparatus 10 to allow each of the wheel brushes 13 and the intermediate brush 14 to rotate about an axis that may be normal to a longitudinal axis of the pool cleaning apparatus 10.

It is noted that the driving unit can rotate one or more of the brushes, and that the number of brushes and their arrangement can differ from those illustrated in FIGS. 1 and 2.

The external housing is illustrated as having two sidewalls 18, an upper shell 12 that has a curved shape, a front portion 17 and a rear portion 19.

It is noted that the terms rear and front are relative as the pool cleaning apparatus 10 can move in opposite directions—towards the rear (backward movement) or towards the front (forward movement).

Figure 3:
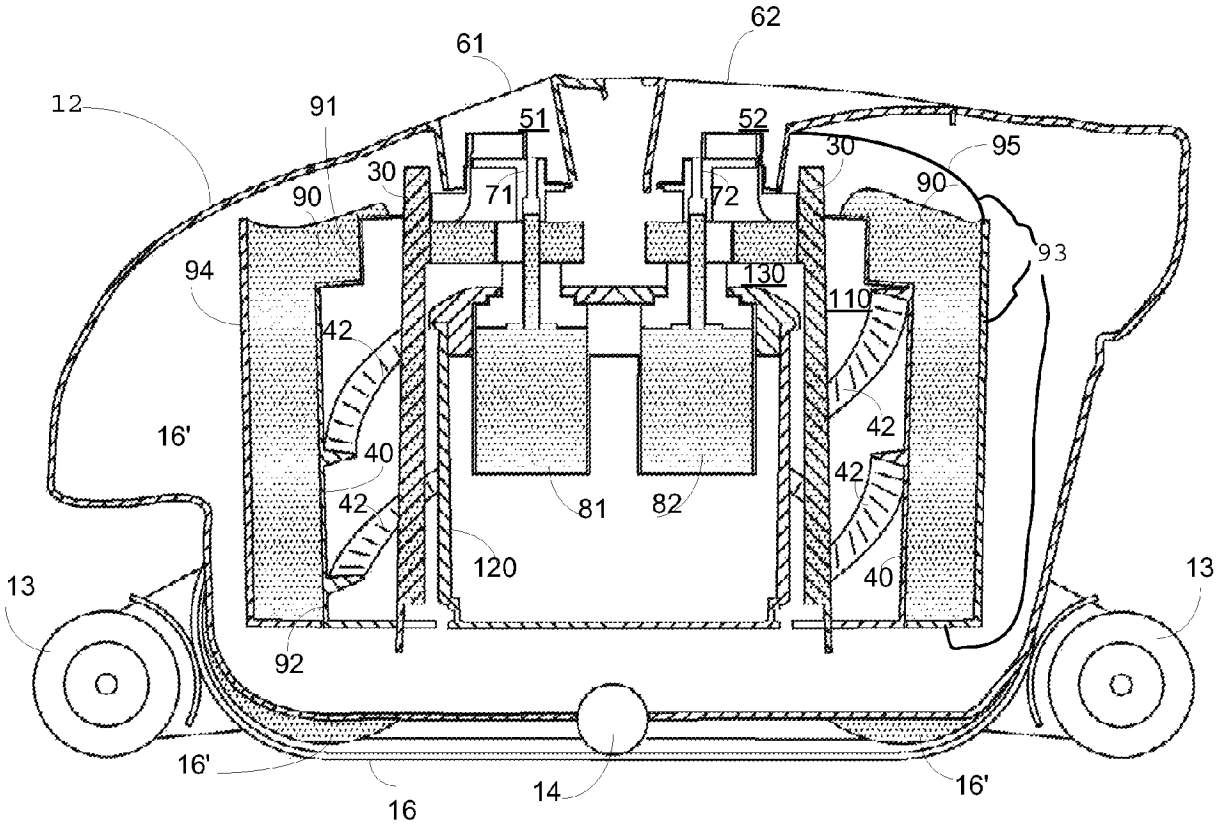
FIG. 3 is a cross sectional view of the pool cleaning apparatus of FIG. 1 taken along a longitudinal axis of the pool cleaning apparatus according to an embodiment of the invention.

FIG. 3 is a cross sectional view of the pool cleaning apparatus 10 taken along a longitudinal axis of the pool cleaning apparatus 10 according to an embodiment of the invention.

FIG. 3 illustrates a filter 30, a entrapment cell 90, a first impeller 71, a first pump motor 81 arranged to rotate the first impeller 71, a second impeller 72, a second pump motor 82 arranged to rotate the second impeller 72, cleaning components such as rear and front brush wheels 13 and intermediate brush 14, driving unit components such as track 16, a structural element that includes a wall 40 and a spiral guide 42 that is connected to the wall 40 and faces the filter 30, a first fluid conduit 51, a first outlet 61, a second fluid conduit 52 and a second outlet 62.

The first impeller 71 can be rotated along a first rotational direction or along a second rotational direction by the first pump motor 81.

The first impeller 71 is rotated about a vertical axis (although it can be oriented in relation to the vertical axis) and is positioned within the first fluid conduit 51 that directs the fluid that is drawn by the first impeller 71 to exit the pool cleaning apparatus 10 at a first direction that can be vertical or be oriented in relation to a vertical direction. FIG. 3 illustrates the first direction as being directed upwards and towards the front end of the pool cleaning apparatus 10. This can be implied by the orientation of the first fluid conduit 51 towards the front of the pool cleaning apparatus.

The second impeller 72 can be rotated along a first rotational direction or along a second rotational direction by the second pump motor 82.

The second impeller 72 is rotated about a vertical axis (although it can be oriented) and is positioned within the second fluid conduit 52 that directs the fluid that is drawn by the second impeller 72 to exit the pool cleaning apparatus at a second direction that can be vertical or be oriented in relation to a vertical direction. FIG. 3 illustrates the second direction as being directed upwards and towards the rear end of the pool cleaning apparatus. This can be implied by the orientation of the second fluid conduit 52 towards the rear of the pool cleaning apparatus.

Both pump motors 81 and 82 are located within a sealed housing 120 that is arranged to prevent contact of these pump motors with fluid. These pump motors (81 and 82) may be located at the center of the pool cleaning apparatus 10.

The sealed housing 120 is surrounded by the filter 30 and may be spaced apart from the filter 30. The sealed housing 120, the first and second impellers 71 and 72 and the first and second fluid conduits 51 and 52 may define a second space 130 in which fluid can flow.

FIG. 3 illustrates the first and second pump motors 81 and 82 as being spaced apart from the bottom panel 20 of the pool cleaning apparatus 10 but they can contact that bottom panel 20.

The first and second pump motors 81 are proximate to each other and are formed along the longitudinal axis of the pool cleaning apparatus 10. The number of pump motors can differ from two and they may be positioned at different locations from each other.

The internal components of the pool cleaning apparatus 10 may be arranged in a co-centric arrangement (or in a non co-centric arrangement). The former is illustrated in FIG. 3 in which the sealed housing 120 is located in proximity to a certain point (such as an imaginary central point) of the pool cleaning apparatus 10, the filter 30 is more distant from that certain point, and it (the filter) is followed by the spiral guide 42 and the wall 40 that in turn are followed by the entrapment cell 90.

The filter 30 may have a cylindrical shape and may surround the sealed housing 120. The filter 30 may be positioned between the second space 130 (in which filtered fluid may flow during a filtering operation) and the first space 110 (in which fluid that is not filtered flows along a spiral path) so that during a filtering operation only filtered fluid can exit through the first and second outlets 61 and 62.

An external face of the filter 30 faces the wall 40 and the spiral guide 42. The wall 40 may be shorter than the filter 30 and fluid that reaches the end of the spiral path can be directed into the entrapment cell 90.

The entrapment cell 90 can have a first input 91 for receiving fluid and can have a filtered opening 92 (that includes an opening that is covered by a filter) that allows fluid to return to the first space 110.

The filtered opening 92 can prevent particles that are too big to pass through filter 30 to return to the first space 110.

Figure 4A:
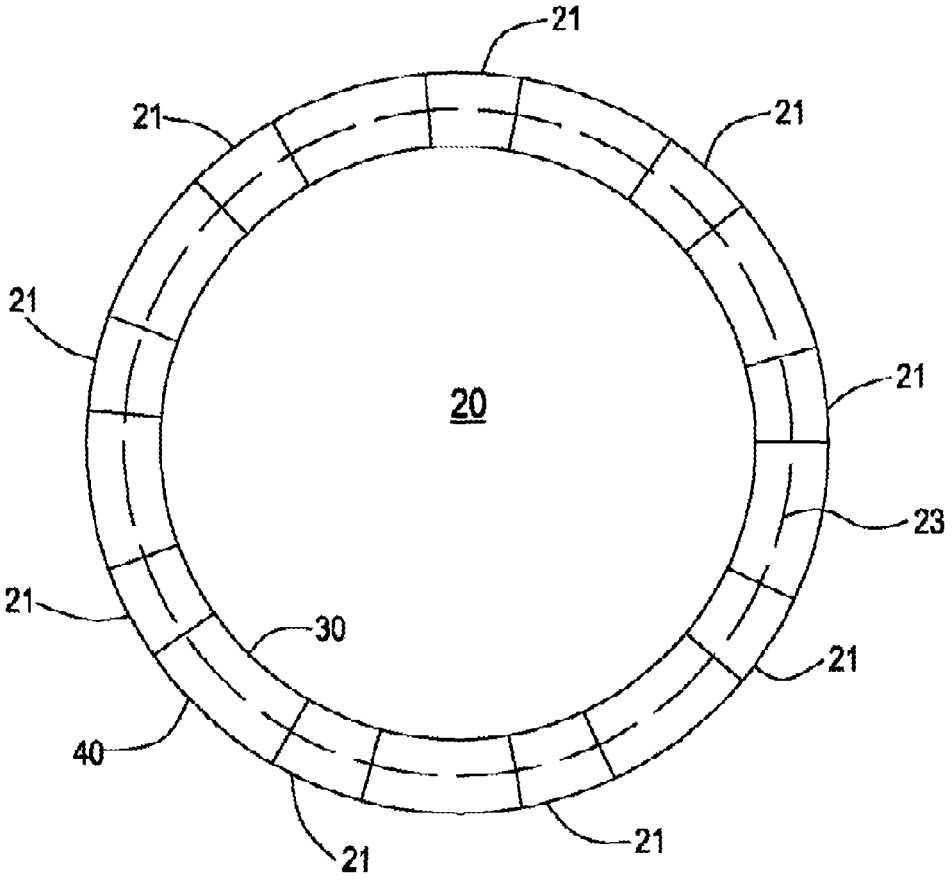
FIG. 4A-4C illustrate multiple inlets of an external housing of the pool cleaning apparatus and multiple movable flaps according to an embodiment of the invention.
Figure 4B:
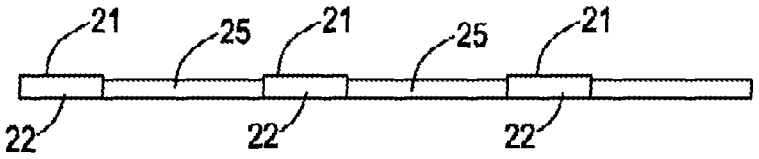
Figure 4C:
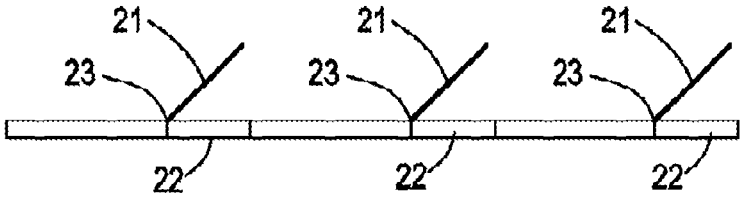

When the first and second impellers 71 and 72 are rotated along a first rotational direction (for example—clockwise or counterclockwise) they cause fluid to be drawn through the first inlets 22 as seen in FIG. 4A-C and to follow a spiral path within the first space 110 during which (a) a first portion of the fluid is filtered by the filter 30 to provide filtered fluid that exits through the first and second outlets 61 and 62 of the external housing 11; and (b) a second portion of the fluid follows the spiral path until entering the entrapment cell 90; wherein the second portion of the fluid conveys particles that did not pass through the filter 30.

The entrapment cell 90 can be formed by the wall 40 and an additional portion such as removable entrapment cell portion 93, the latter may have a radial symmetry. FIG. 3 illustrates the removable entrapment cell portion 93 a having a lower horizontal part, a relatively long vertical part and a oriented top part 95 that is detachably attached to the top edge of filter 30.

The upper shell 12 of the external housing 11 can be removed and thus expose the internal components of the pool cleaning apparatus 10. The entrapment cell 90 and the filter 30 can be detached from the pool cleaning apparatus 10 for cleaning and replacement purposes.

Figure 21:
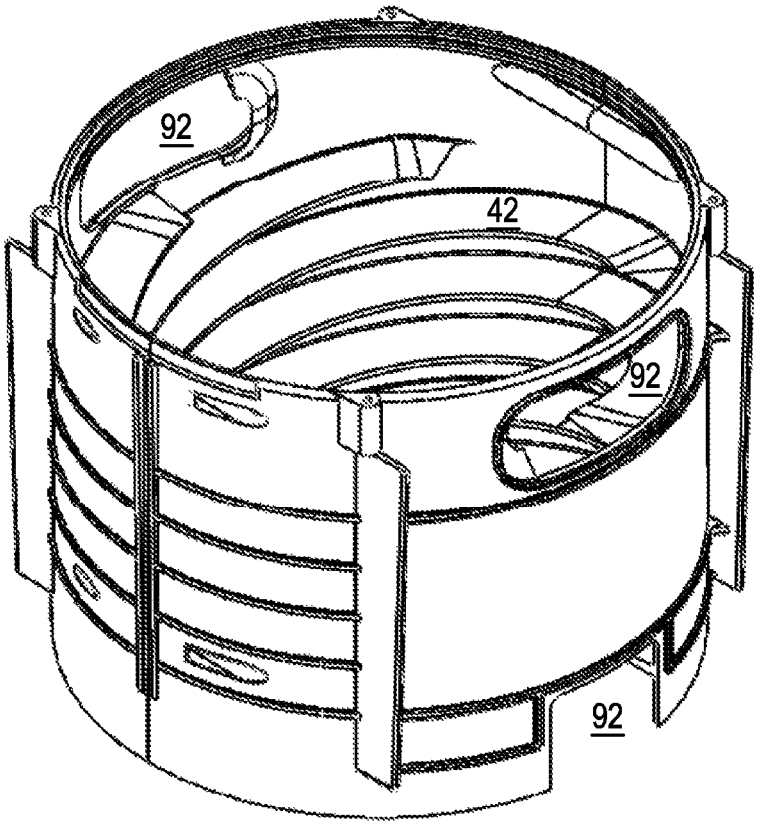
FIG. 21 illustrates portions of the filtering unit according to various embodiments of the invention.

FIG. 21A illustrates a structural element that comprises the spiral guide 42, wall 40, filtered inputs 91 and filtered opening 92. The filtered openings are illustrated as located at the lower part of wall 40 while the first inputs 91 are illustrated as positioned at the top of the wall 40. The first inputs 91 can be selectively sealed by uni-directional valves or by removable flaps that may prevent (or at least reduce) the flow of fluid via the first inputs 91 from the entrapment cell 90 to the first space. FIG. 21B illustrates the spiral guide 42 as being connected to a circular mesh 314.

FIGS. 4A-4C illustrate multiple inlets 22 formed in the bottom panel 20 and their movable flaps 21.

It is noted that multiple inlets (not shown) are also formed at the bottom of the filtering unit 300. These multiple inlets can have the same shape and size as the inlets formed in the bottom panel 20 or may differ by shape and/or size. The number of inlets formed at the bottom of the filtering unit 300 may differ or be the same as the number of multiple inlets of the bottom panel. The inlets formed at the bottom of the filtering unit 300 and the inlets formed at the bottom panel 20 can be aligned, misaligned, overlapping, partially overlapping and the like.

The multiple inlets 22 are located between the filter 30 and the wall 40 within a ring shaped portion of a bottom panel 20 of the external housing 11.

Each inlet 22 is proximate to a movable flap 21. Each movable flap 21 may be arranged to move between (i) an inlet closing position and a (ii) fluid directing position. Each movable flap 21 may be pivotally connected to the bottom panel 20 and can be induced to move upwards to enter the fluid directing position when the first or second impeller are rotated along the first rotational direction.

Each movable flap 21, when positioned at the fluid directing position, may be arranged to direct the fluid upwards and towards the spiral guide.

When all the movable flaps 21 are at their fluid directing position they are tilted so that fluid first contacts their lower edge and finally contacts their upper edge to be directed towards the spiral guide 42.

When positioned at the inlet closing position—the movable flaps 21 may seal the inlets 22 and prevent particles to exit the pool cleaning apparatus.

Each one of the first and second impellers 71 and 72 when being rotated along a second rotational direction (that is opposite to the first rotational direction) may assist in performing a backwash operation during which fluid is drawn to enter the pool cleaning apparatus via at least one of outlets 61 and 62 and pass from the second space 130 to the first space 110 and clean filter 30.

According to an embodiment of the invention the duration of any backwashing operation is shorter (and even much shorter) than the duration of the filtering operation. For example, the duration of the backwashing operation can be one second, less than second, less then five seconds, less than a minute and the like. Yet for another example, the duration of the filtering operation can exceed a minute, can exceed ten minutes, can exceed an hour and the like.

There can be provided other means for reducing (and even eliminating) the amount of dirt that is outputted from the cleaning robot to the pool as a result of the backwashing operation. These means may include uni-directional valves, movable flaps or other mechanical means that reduce the flow of dirt and fluid outside the cleaning robot during the backwashing operation.

FIG. 3 also illustrates that the entrapment cell 90 has a first opening 91 for receiving the second portion of fluid, the first opening 91 is at least partially defined by an upper rim of the wall 40. Fluid directing elements 94 that extends (for example—radially extend) between the wall 40 and the filter 30 may be arranged to direct fluid that reaches the end of the spiral path to enter the entrapment cell 90.

Each of the first and second impellers 71 and 72 may be independently controllable.

Figure 5:
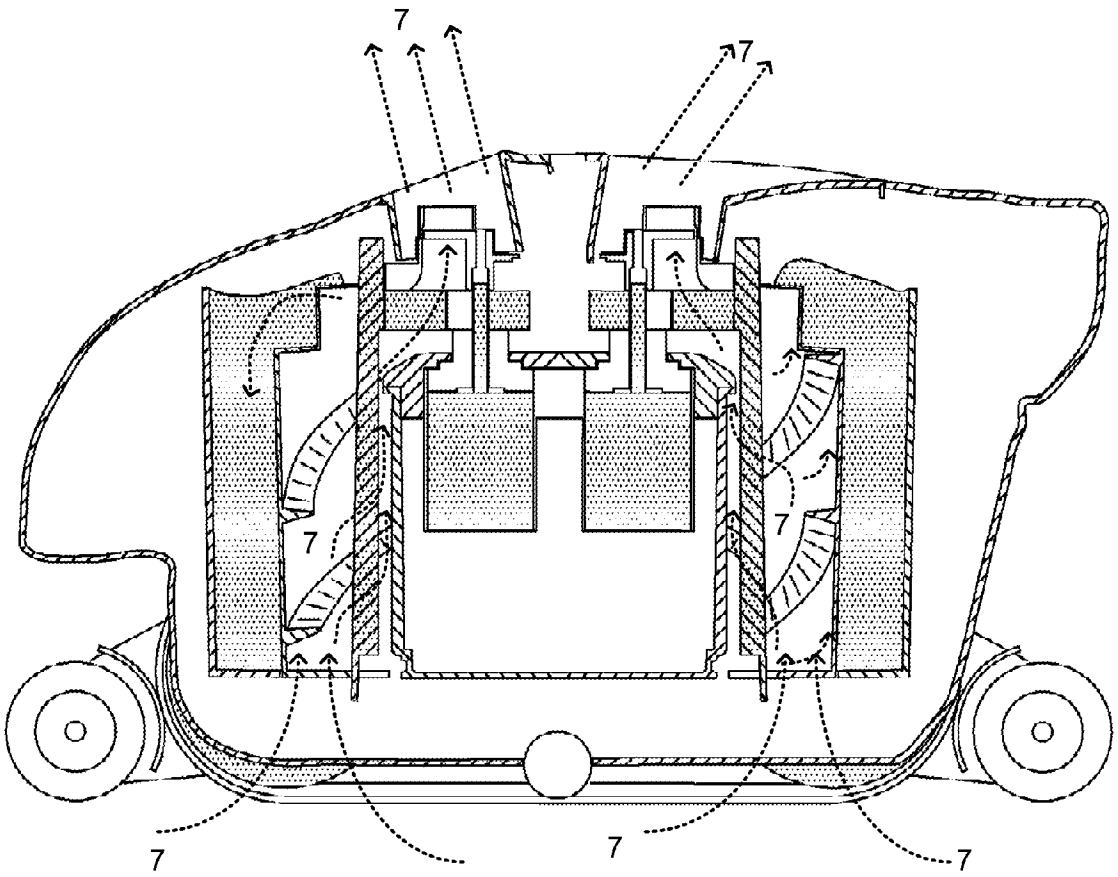
FIG. 5 illustrates the flow of fluid through the pool cleaning apparatus when both impellers are rotated along a first rotational direction according to an embodiment of the invention.
Figure 6:
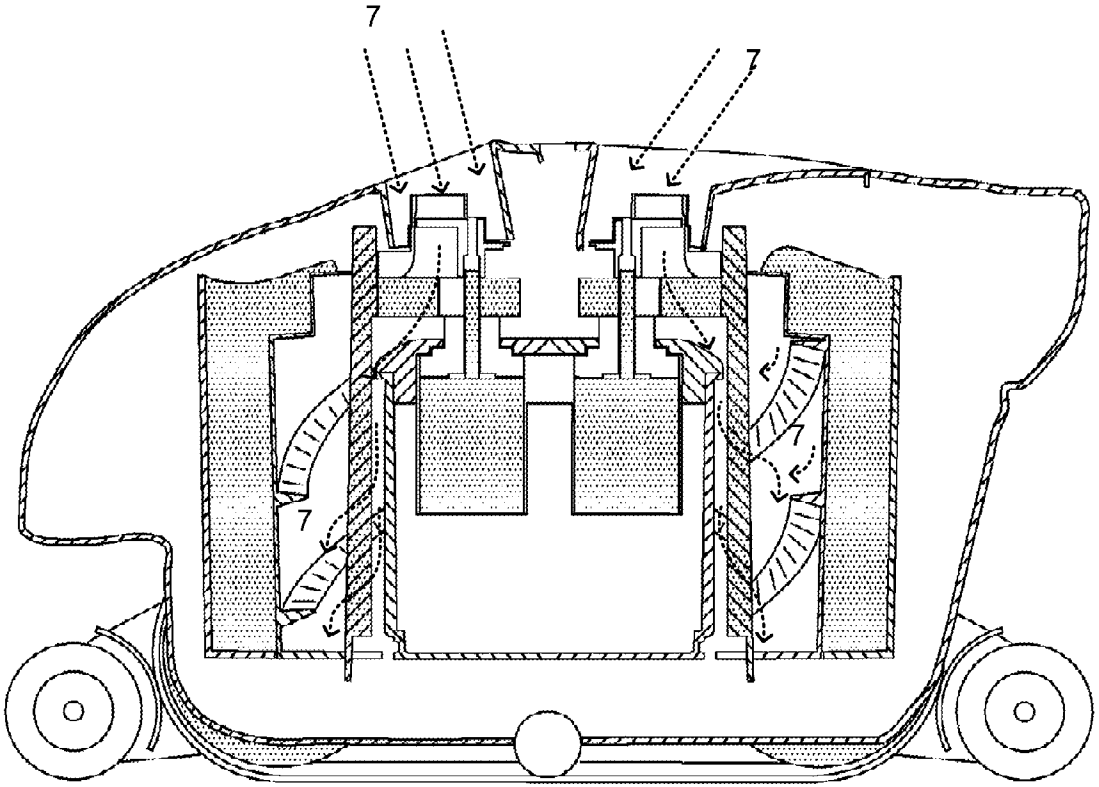
FIG. 6 illustrates the flow of fluid through the pool cleaning apparatus when both impellers are rotated along a second rotational direction according to an embodiment of the invention.
Figure 7:
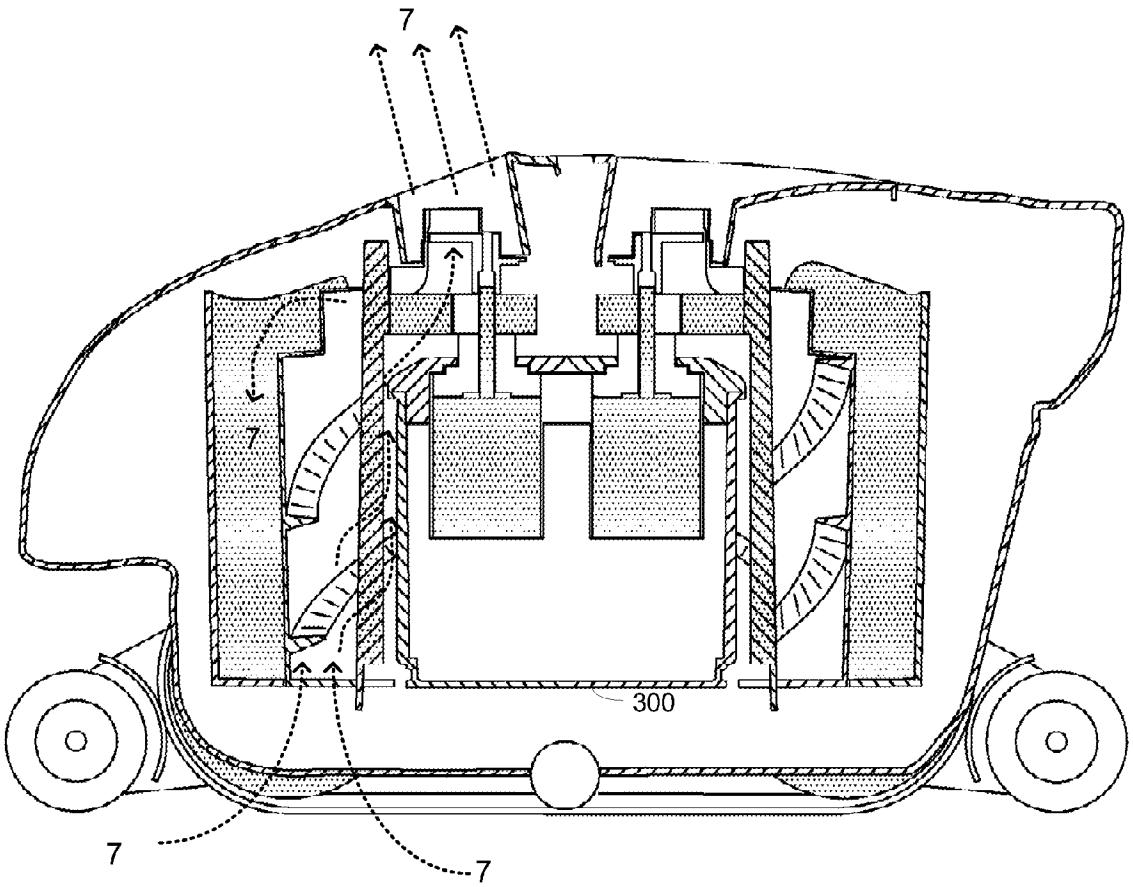
FIG. 7 illustrates the flow of fluid through the pool cleaning apparatus when a first impeller rotates along a first rotational direction and a second impeller is static according to an embodiment of the invention.

In FIGS. 5-7 dashed arrows denoted 7 illustrate the flow of fluid.

FIG. 5 illustrates the flow of fluid through the pool cleaning apparatus when both impellers are rotated along a first rotational direction according to an embodiment of the invention. FIG. 5 illustrates the fluid that is drawn to enter via inlets 22 be directed towards the spiral guide 42 by movable flaps 21, a portion of the fluid partially filtered by filter 30 to be provided to first and second impellers 71 and 72 and to exit the pool cleaning apparatus 10 via outlets 61 and 62, another portion flows within the first space 110 along a spiral path and finally enters the entrapment cell 90.

FIG. 6 illustrates the flow of fluid through the pool cleaning apparatus 10 when both impellers 71 and 72 are rotated along a second rotational direction according to an embodiment of the invention. This may result in a backwash operation in which fluid enters the second space 130 and then passes through the filter 30 and may remove particles that have been attached to the filter 30 during the filtering process. The movable flaps may be closed and fluid that flows through the first space 110 may remain at the first space or at least partially reach the entrapment cell 90.

FIG. 7 illustrates the flow of fluid through the pool cleaning apparatus 10 when the first impeller 71 rotates along a first rotational direction and the second impeller 72 is static. In this case the filtering is induced by the first impeller 71 and filtered fluid may exit the pool cleaning apparatus via the first outlet 61. This operation comes to aid in maneuvering the apparatus backwards or forwards overcoming obstacles or slopes or climbing walls.

Figure 8:
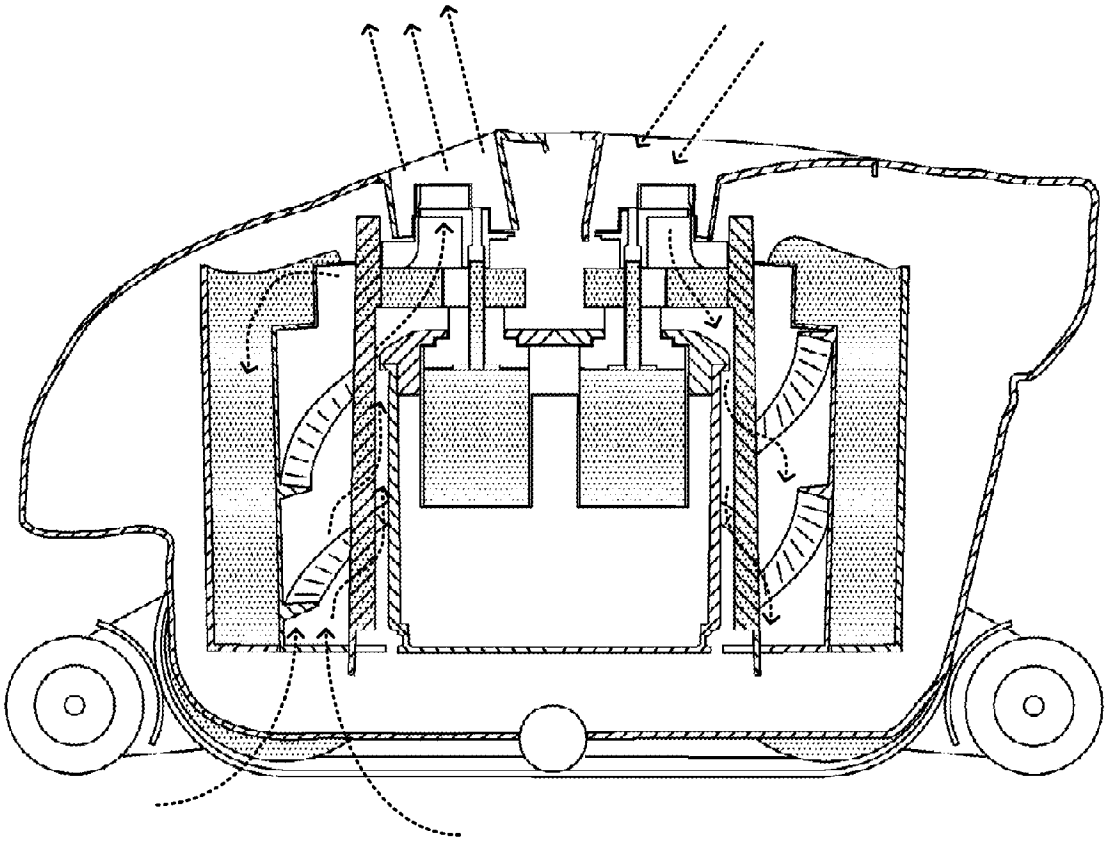
FIG. 8 illustrates the flow of fluid through the pool cleaning apparatus when a first impeller rotates along a first rotational direction and a second impeller rotates along a second rotational direction according to an embodiment of the invention.

FIG. 8 illustrates the flow of fluid through the pool cleaning apparatus when the first impeller 71 rotates along a first rotational direction and induces a filtering process and the second impeller 72 rotates along a second rotational direction to aid in maneuvering the apparatus backwards or forwards overcoming obstacles or slopes or climbing walls or performing a backwashing process. Fluid enters the pool cleaning apparatus via the inlets 22 and the second outlet 62. The first impeller induces fluid to be filtered by filter 30 and to exit through the first opening 61 and further induces the fluid in the first space 110 that is not filtered to follow a spiral path till reaching the entrapment cell 90. The second impeller causes fluid from the second opening to pass through the filter 30 and enter the first space 110.

Figure 9:
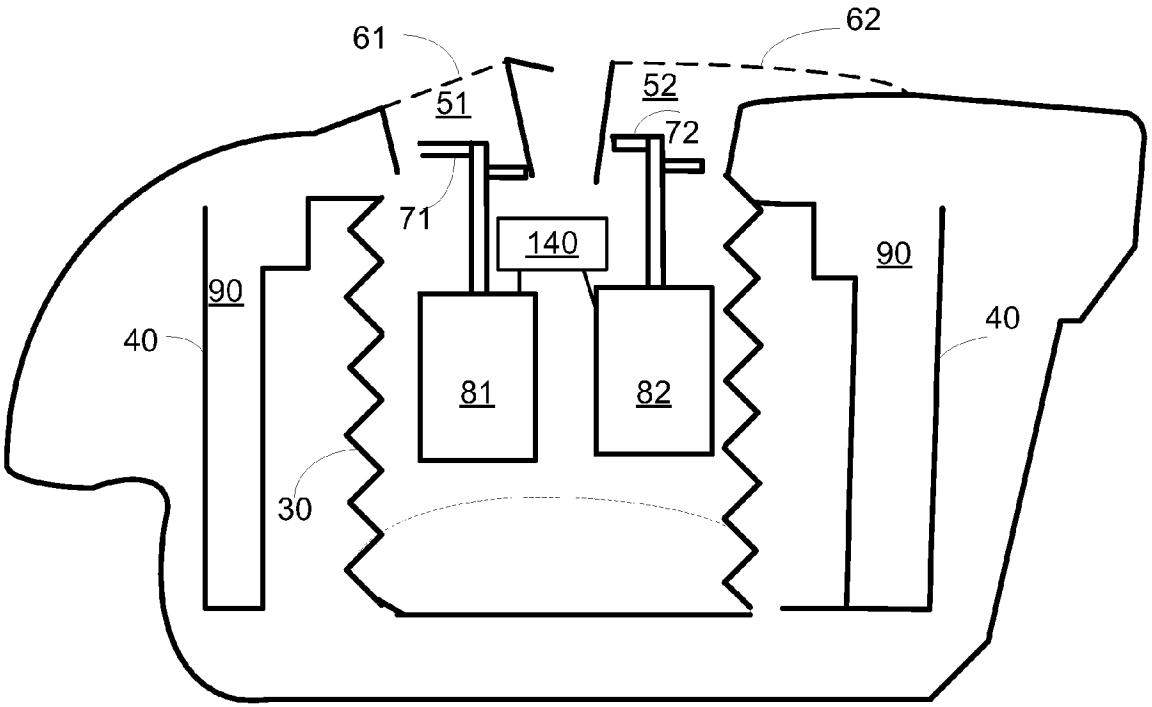
FIG. 9 is a cross sectional view taken along a longitudinal axis of a pool cleaning apparatus according to an embodiment of the invention.

According to an embodiment of the invention the filter 30 may have a spiral shape—this is illustrated in FIG. 9.

It is noted that in order to propagate forwards (a) the first impeller 71 and the second impeller 72 rotate about the first rotational direction while the speed of the first impeller 72 is lower than the speed of the second impeller 72, (b) the first impeller 71 and the second impeller 72 rotate about the second rotational direction while the speed of the first impeller 72 is higher than the speed of the second impeller 72, (c) the first impeller 71 rotates about the second rotational direction and the second impeller 72 rotates about the first rotational direction.

It is noted that in order to propagate backwards (a) the first impeller 71 and the second impeller 72 rotate about the first rotational direction while the speed of the first impeller 72 is higher than the speed of the second impeller 72, (b) the first impeller 71 and the second impeller 72 rotate about the second rotational direction while the speed of the first impeller 72 is lower than the speed of the second impeller 72, (c) the first impeller 71 rotates about the first rotational direction and the second impeller 72 rotates about the second rotational direction.

The backwards and forward movements can be applied in order to overcome obstacles, climb walls and the like.

FIG. 11 illustrates method 900 for cleaning a pool according to an embodiment of the invention.

Method 900 may include stage 910 of rotating a first impeller of a pool cleaning apparatus that is located within the pool, along a first rotational direction thereby causing fluid to be drawn through a first inlet of an external housing of the pool cleaning apparatus and to follow a spiral path within a first space of the pool cleaning apparatus. The rotating causes filtering a first portion of the fluid that follows the spiral path by a filter of the pool cleaning apparatus to provide filtered fluid and allowing the filtered fluid to exit through a first outlet of the external housing. The spiral flow also causes receiving at an entrapment cell of the pool cleaning apparatus a second portion of the fluid that completes the spiral path, wherein the second portion of the fluid conveys particles that are too big to pass through the filter.

Stage 910 may be followed by backwashing (stage 920) the filter or removing (stage 930) the filter.

Method 900 can be executed by any of the pool cleaning apparatuses mentioned above. Method 900 can be executed while the pool cleaning apparatus moves within the pool or remains static.

Figure 10:
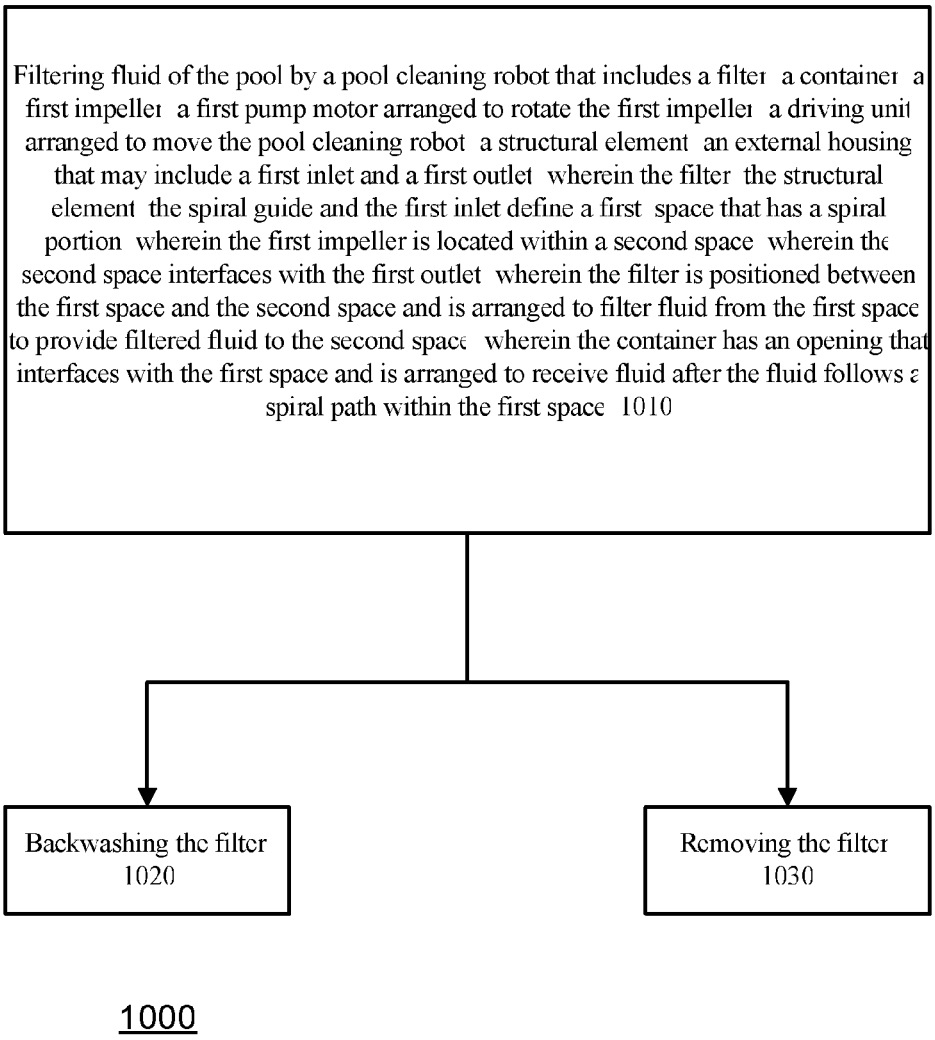
FIG. 10 illustrates a method according to an embodiment of the invention.

FIG. 10 illustrates method 1000 for cleaning a pool according to an embodiment of the invention.

Method 1000 may include stage 1010 of filtering fluid of the pool by a pool cleaning apparatus that includes a filter; a entrapment cell; a first impeller; a first pump motor arranged to rotate the first impeller; a driving unit arranged to move the pool cleaning apparatus; a structural element; an external housing that may include a first inlet and a first outlet; wherein the filter, the structural element, the spiral guide and the first inlet define a first space that has a spiral portion; wherein the first impeller is located within a second space; wherein the second space interfaces with the first outlet; wherein the filter is positioned between the first space and the second space and is arranged to filter fluid from the first space to provide filtered fluid to the second space; wherein the entrapment cell has an opening that interfaces with the first space and is arranged to receive fluid after the fluid follows a spiral path within the first space.

Stage 1010 may be followed by backwashing (stage 1020) the filter or removing (stage 1030) the filter.

Method 1000 can be executed by any of the pool cleaning apparatuses mentioned above. Method 1000 can be executed while the pool cleaning apparatus moves within the pool or remains static.

Figure 13:
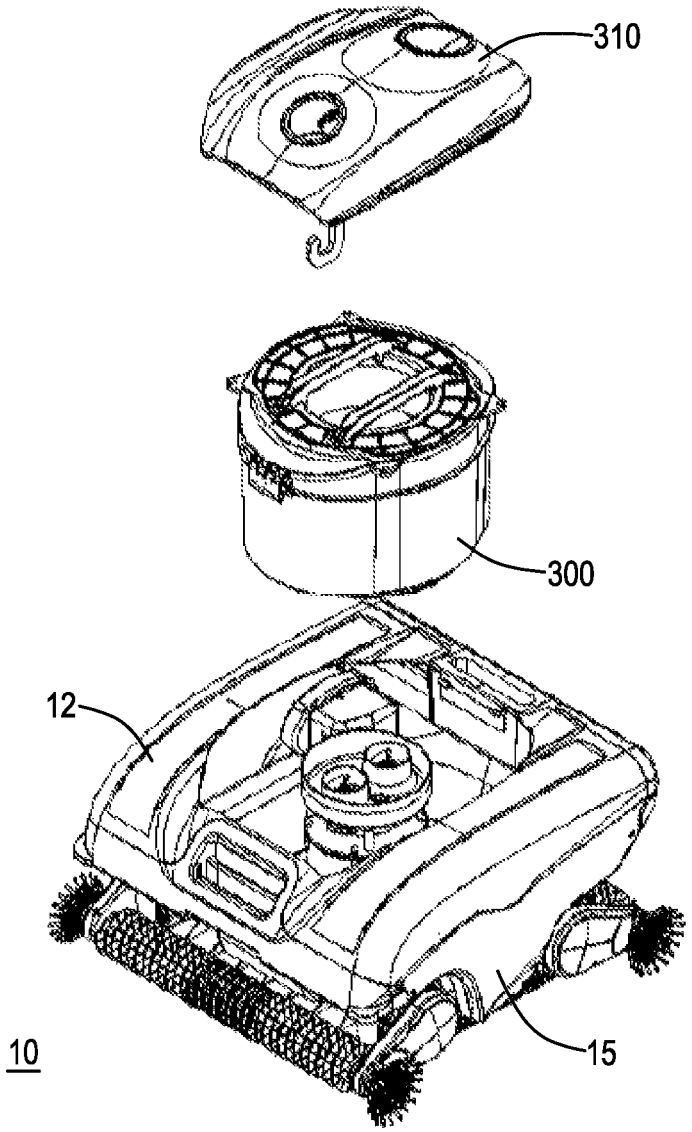
FIG. 13 is an exploded view of the pool cleaning apparatus, the external cover and the filtering unit according to an embodiment of the invention.

According to various embodiments of the invention there is provided a filtering unit 300 as illustrated in FIG. 13) that is detachably coupled to other parts of the pool cleaning apparatus. The filtering unit 300 may be placed below an external cover 310 that may be detachably coupled to the external housing 11 of the pool cleaning apparatus. This allows to remove the filtering unit 300, and remove the particles that are aggregated within the filtering unit 300. The following figures illustrate some embodiments of a pool cleaning apparatus and a filtering unit. It is noted that any of the previously illustrated pool cleaning apparatuses can have similar filtering units that are detachably coupled to other parts of the pool cleaning apparatus.

Figure 12A:
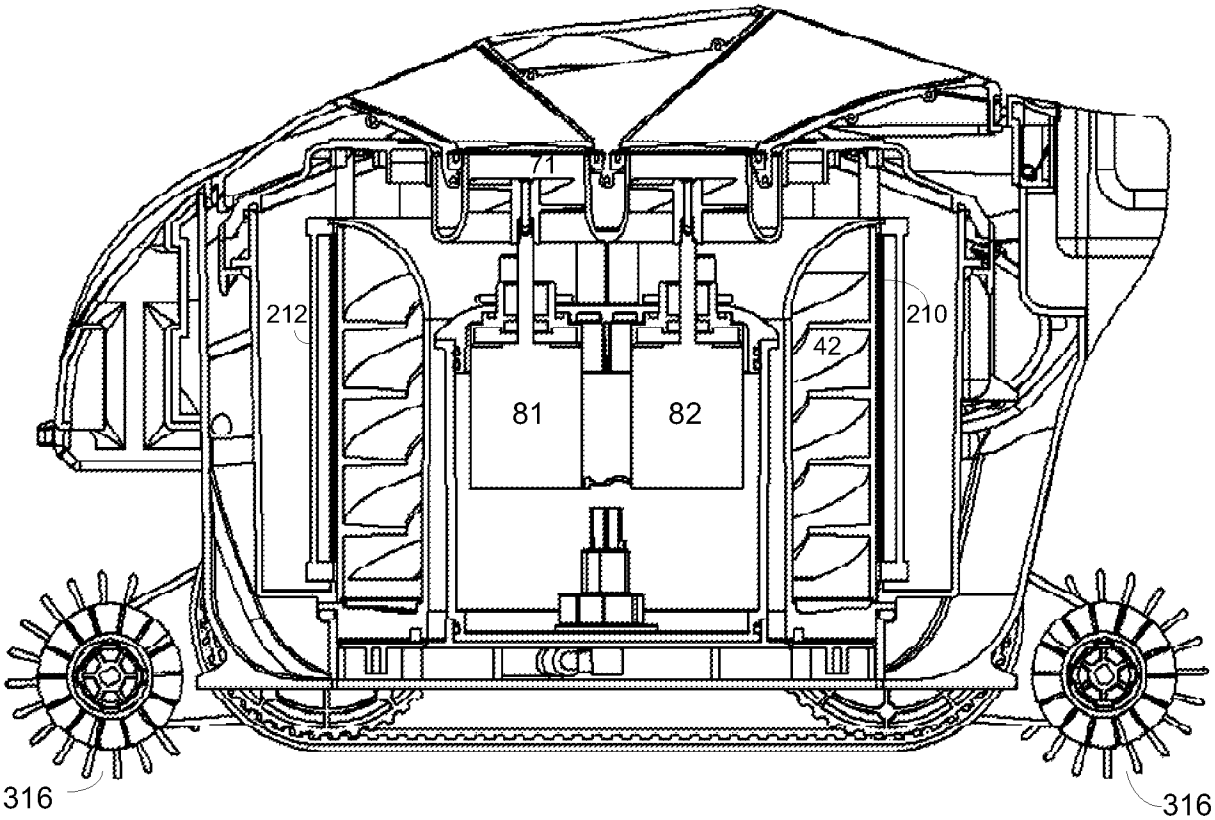
FIG. 12A is a cross sectional view of a pool cleaning apparatus according to an embodiment of the invention.
Figure 12B:
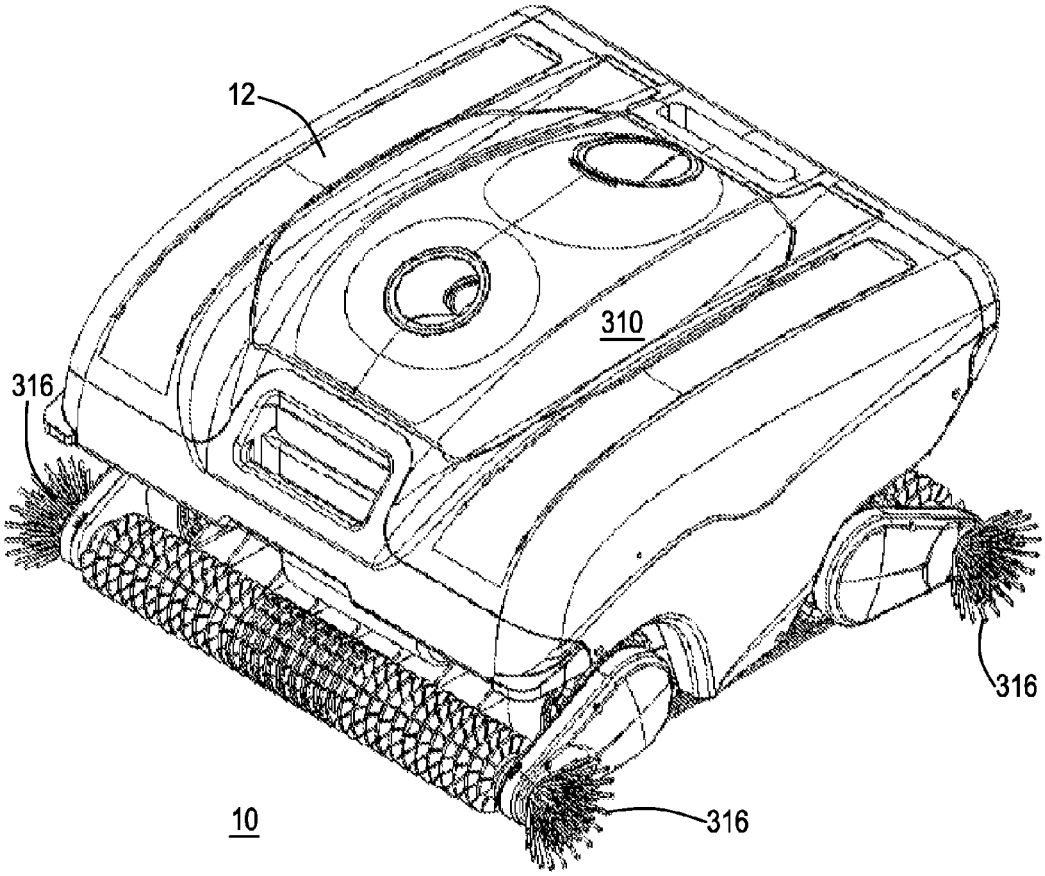
FIG. 12B illustrates a pool cleaning apparatus according to an embodiment of the invention.
Figure 14:
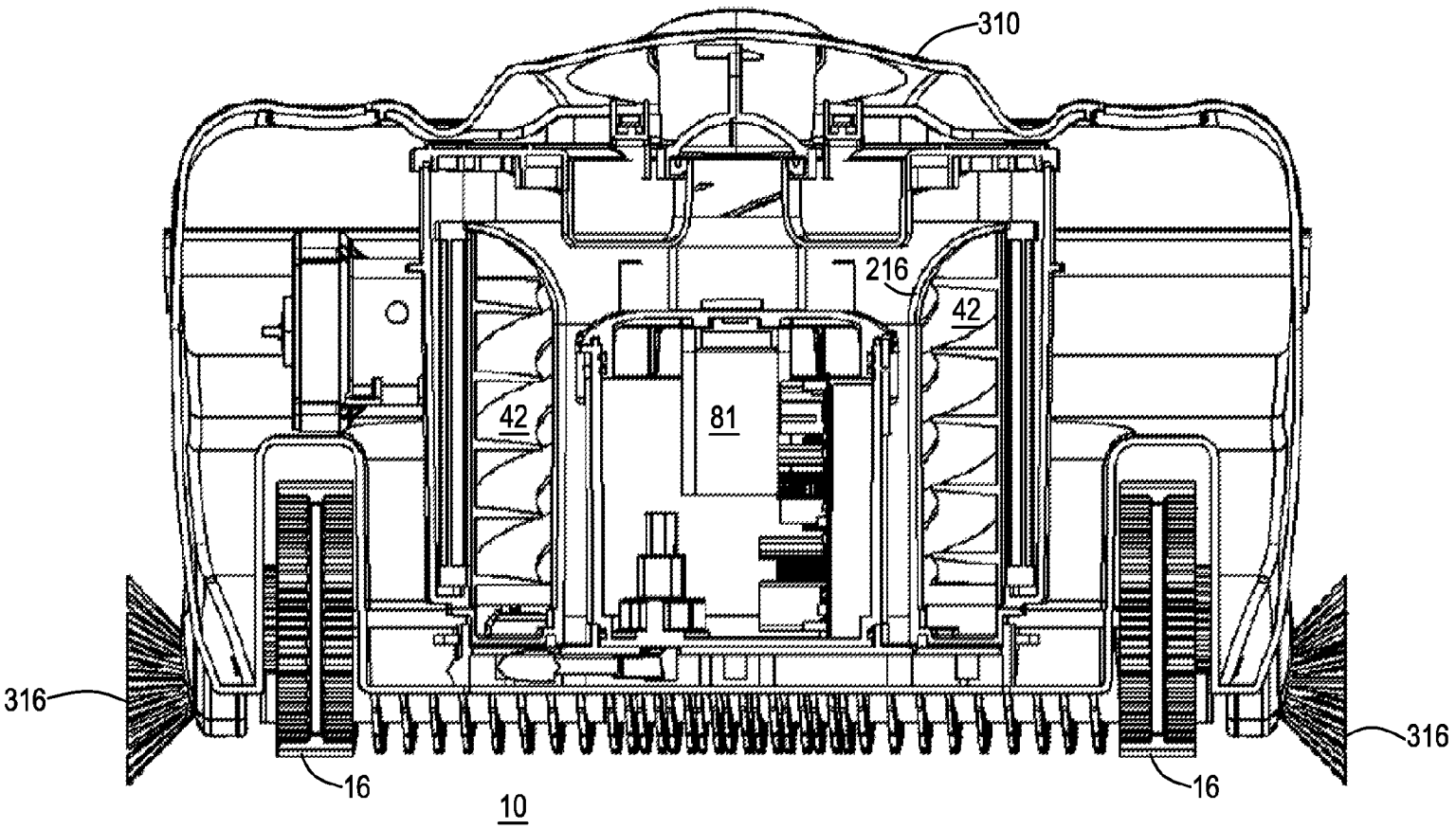
FIG. 14 is a cross sectional view taken along a traverse axis of a pool cleaning apparatus according to an embodiment of the invention.
Figure 15A:
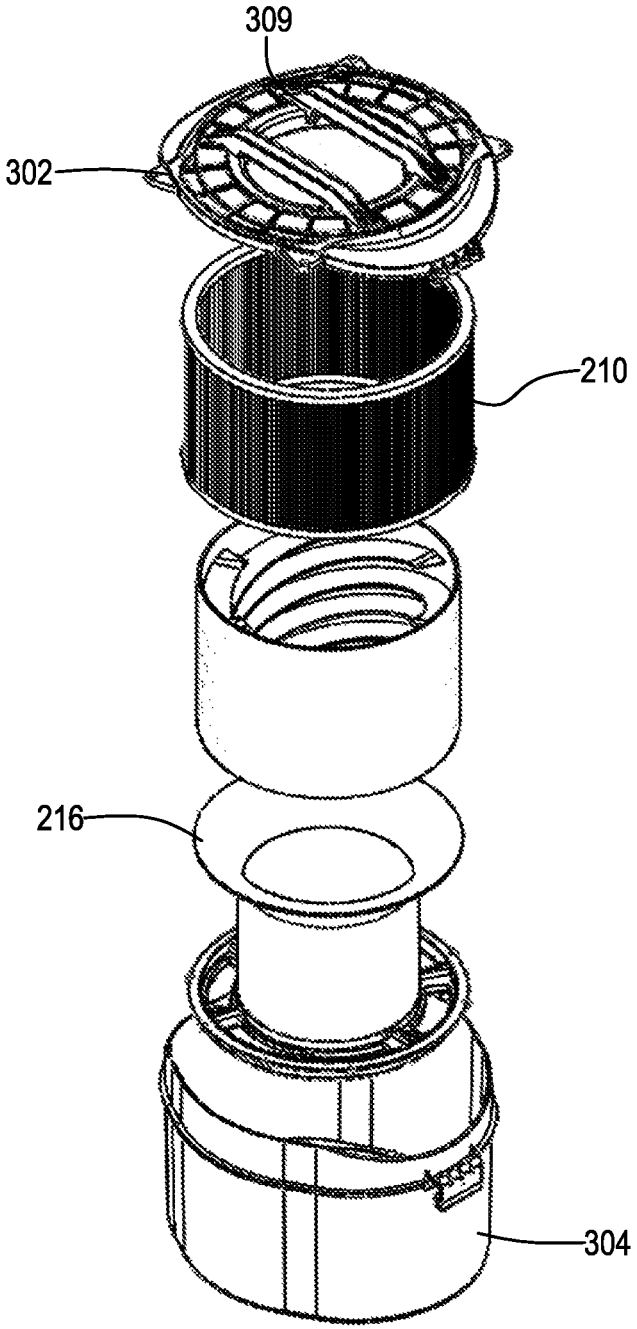
FIGS. 15A and 15B illustrate the filtering unit according to an embodiment of the invention.
Figure 15B:
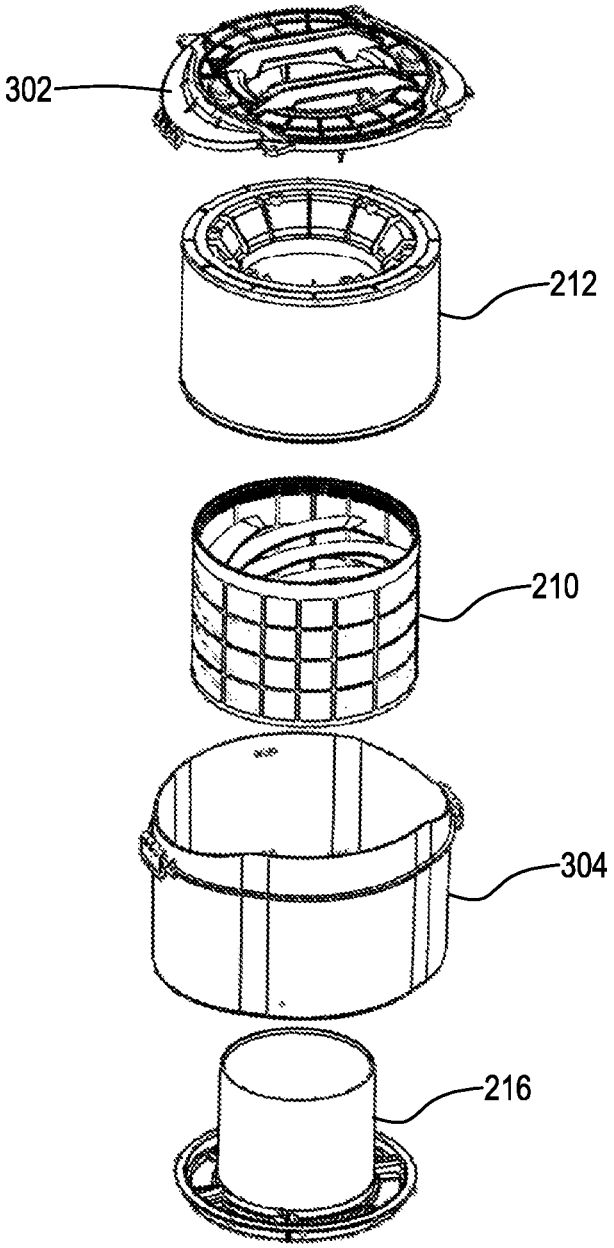
Figure 16:
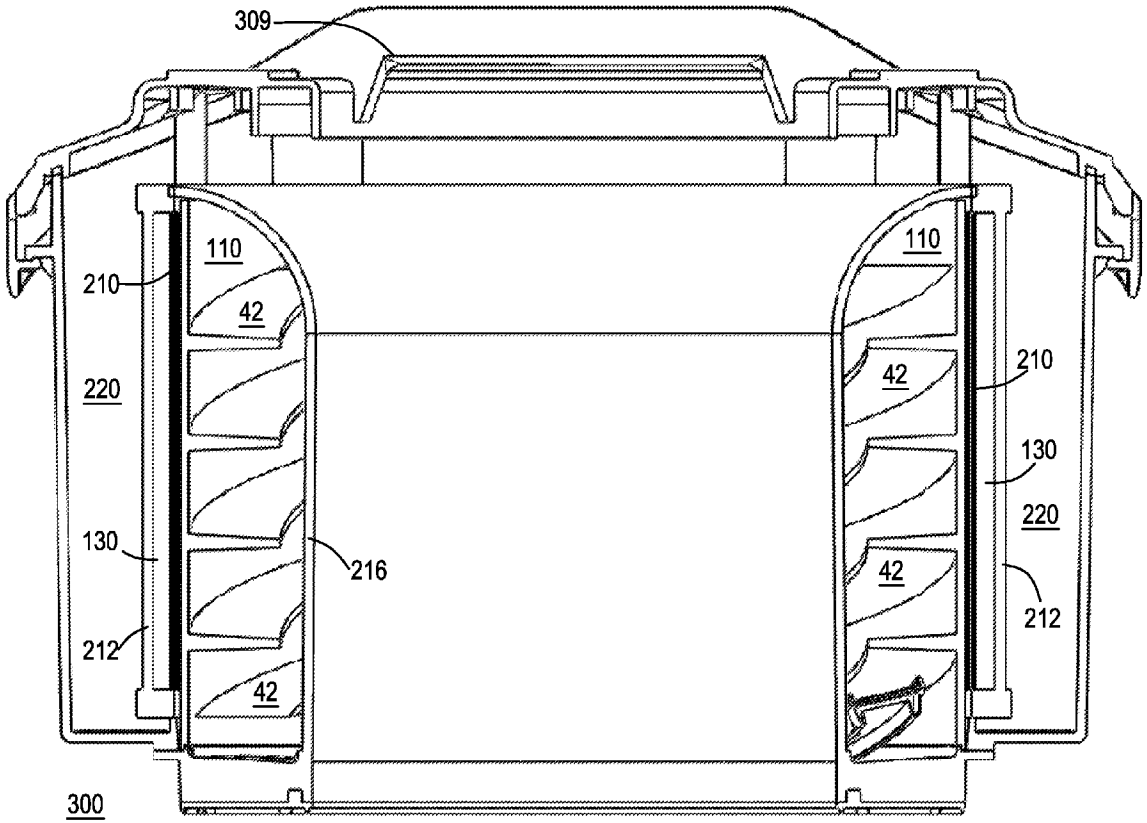
FIG. 16 is a cross sectional view of the filtering unit according to an embodiment of the invention.
Figure 17:
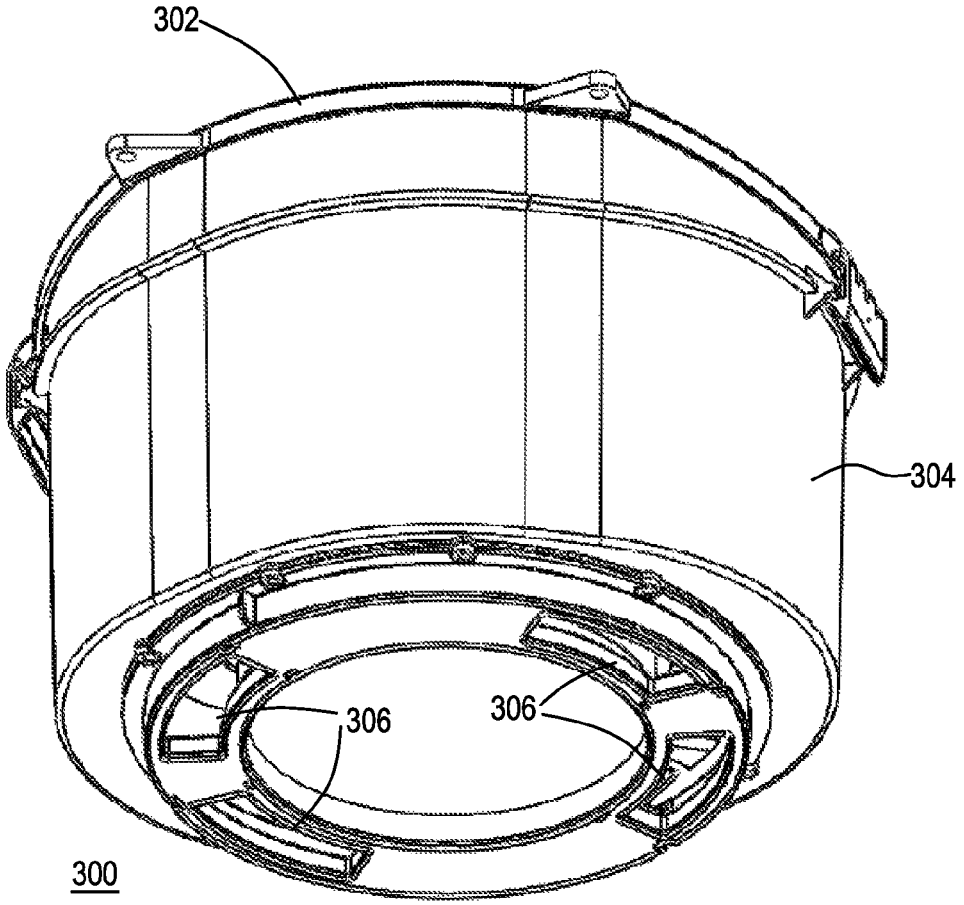
FIG. 17 illustrates the bottom of the filtering unit according to an embodiment of the invention.
Figure 18:
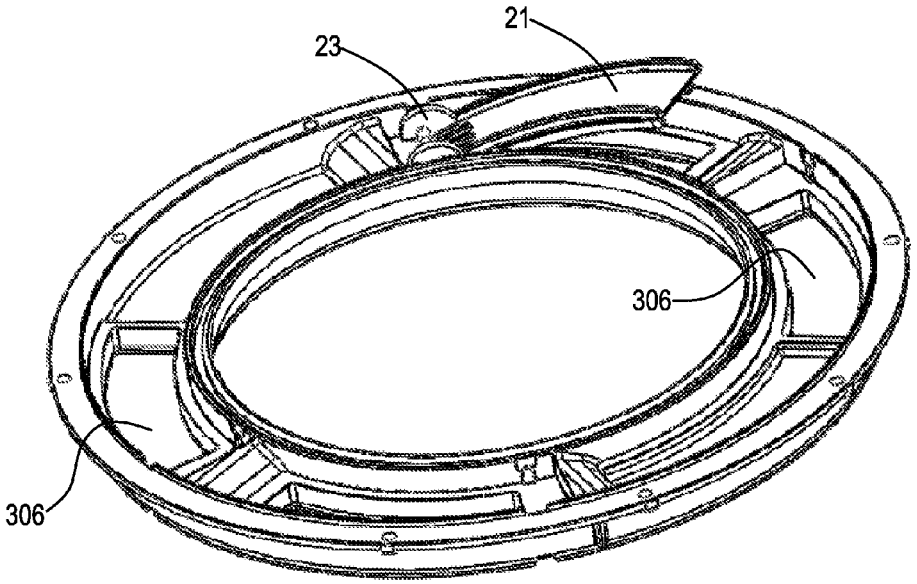
FIG. 18 illustrates multiple filtering unit inlets and a movable flap according to an embodiment of the invention.
Figure 19:
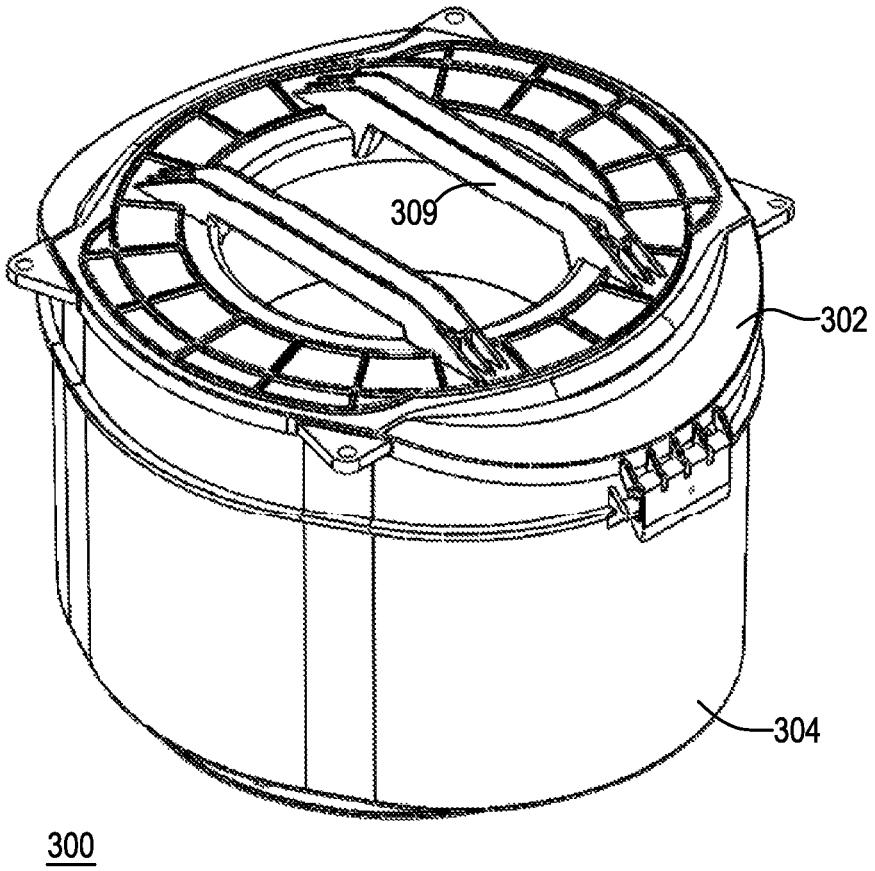
FIG. 19 is a top view of the filtering unit according to an embodiment of the invention.
Figure 20:
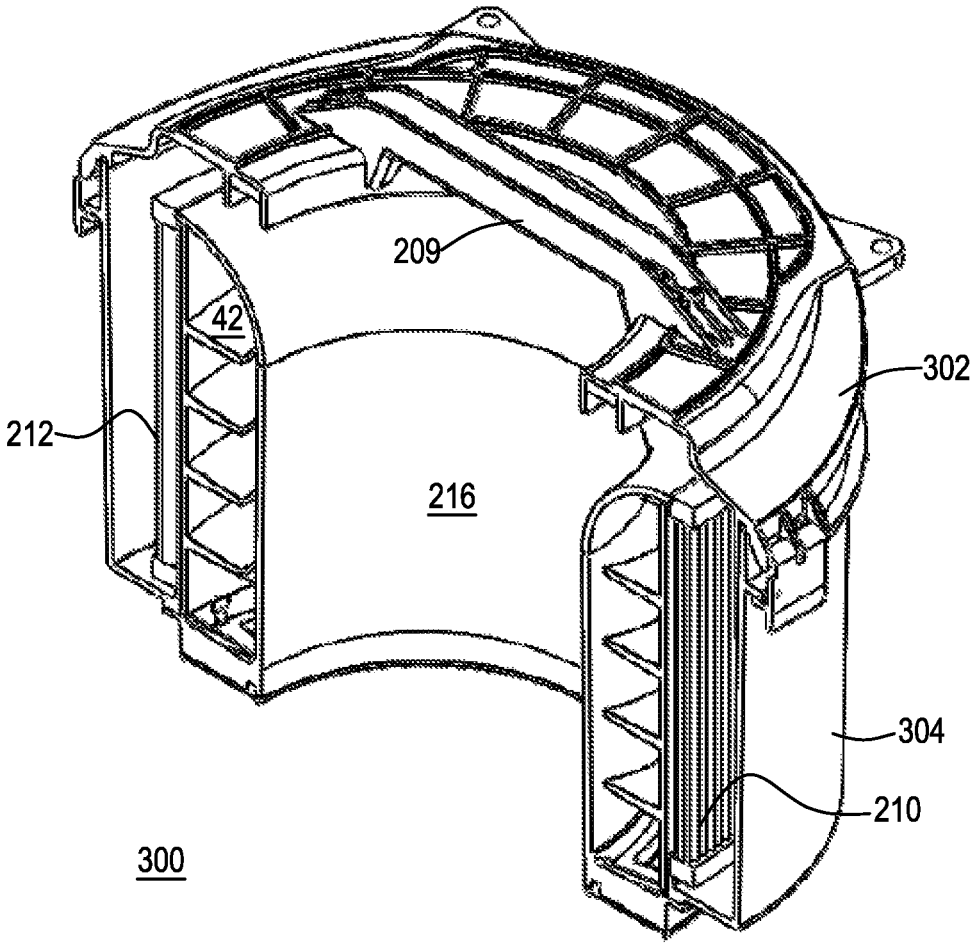
FIG. 20 provides a cross sectional view and a top view of filtering unit according to an embodiment of the invention.
Figure 22:
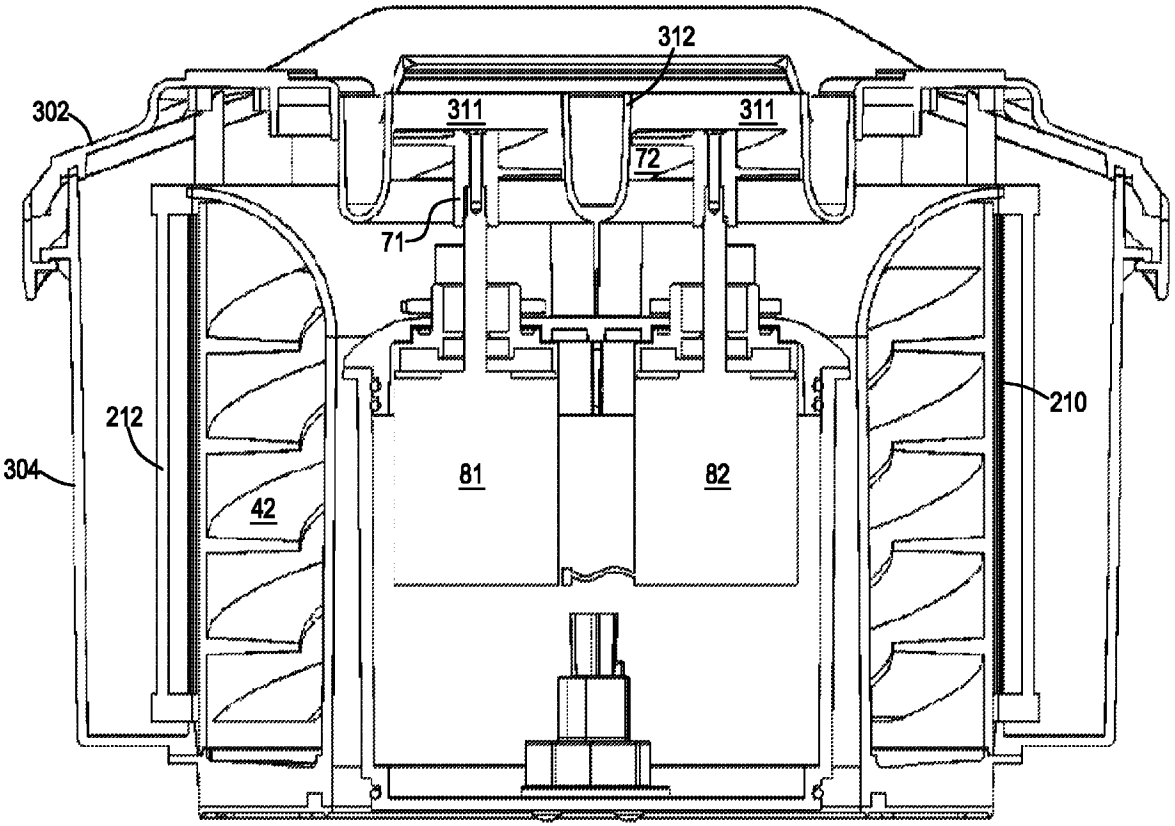
FIG. 22 is a cross sectional view of the filtering unit and a propulsion module according to an embodiment of the invention.
Figure 23:
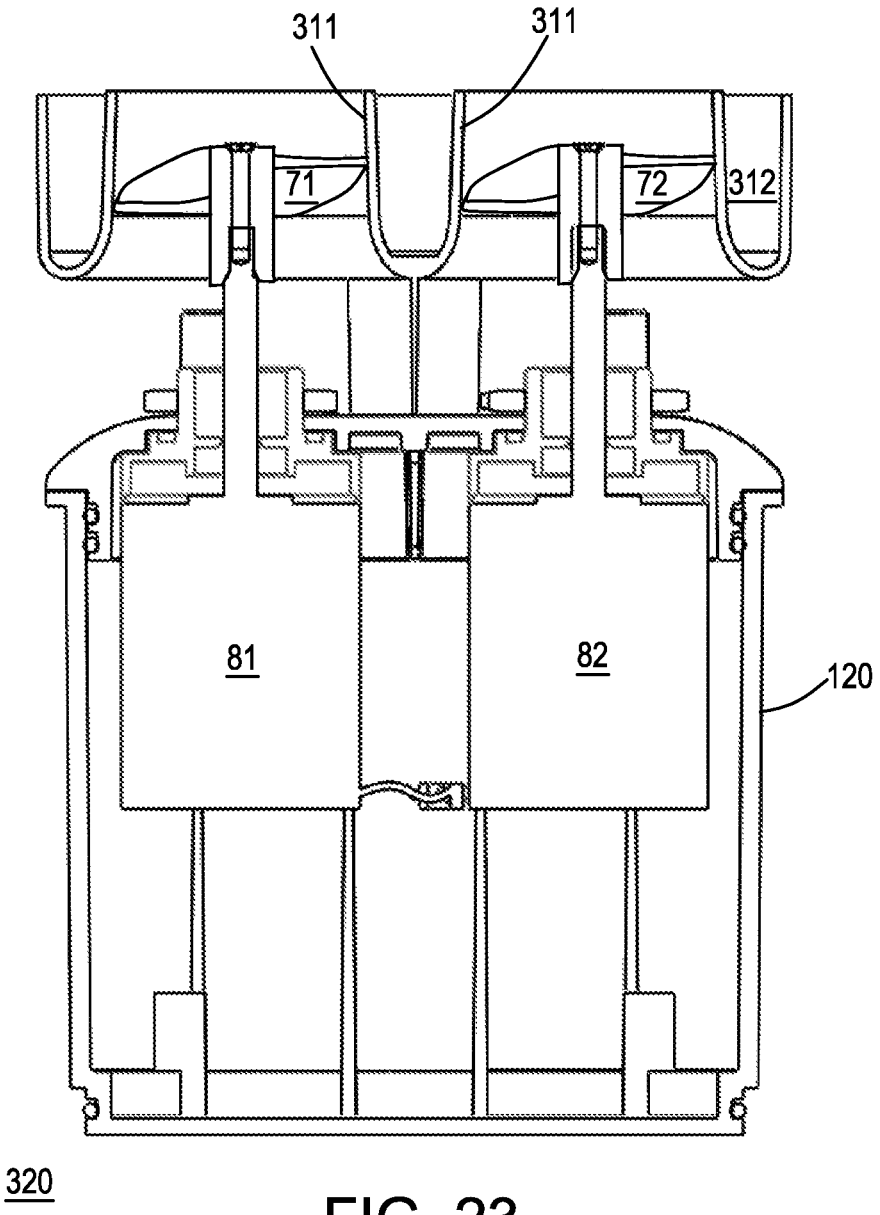
FIG. 23 is a cross sectional view of the propulsion module according to an embodiment of the invention.
Figure 24:
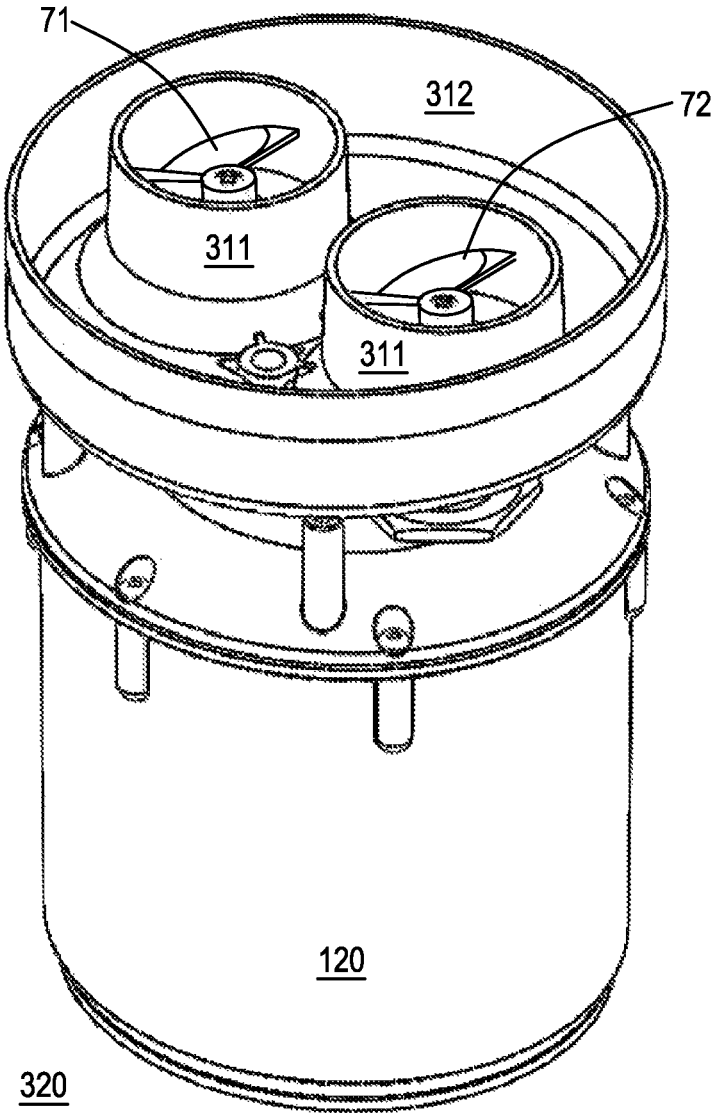
FIG. 24 illustrates the propulsion module according to an embodiment of the invention.

FIG. 12A is a cross sectional view taken along a longitudinal axis of a pool cleaning apparatus 10 according to an embodiment of the invention. FIG. 12B illustrates a pool cleaning apparatus 10 according to an embodiment of the invention. FIG. 13 is an exploded view of the pool cleaning apparatus 10, the external cover 310 and the filtering unit 300 according to an embodiment of the invention. FIG. 14 is a cross sectional view taken along a traverse axis of a pool cleaning apparatus 10 according to an embodiment of the invention. FIGS. 15A and 15B illustrate the filtering unit 300 according to an embodiment of the invention FIG. 16 is a cross sectional view of the filtering unit 300 according to an embodiment of the invention. FIG. 17 illustrates the bottom of the filtering unit 300 according to an embodiment of the invention. FIG. 18 illustrates multiple filtering unit inlets 306 and a movable flap 21 according to an embodiment of the invention. FIG. 19 is a top view of the filtering unit 300 according to an embodiment of the invention. FIG. 20 provides a cross sectional view and a top view of filtering unit 300 according to an embodiment of the invention. FIG. 22 is a cross sectional view of the filtering unit 300 and a propulsion module 320 not specified according to an embodiment of the invention. FIG. 23 is a cross sectional view of the propulsion module 320 according to an embodiment of the invention. FIG. 24 illustrates the propulsion module 320 according to an embodiment of the invention.

FIG. 12A is a cross sectional view of the pool cleaning apparatus 10 according to an embodiment of the invention.

According to an embodiment of the invention the speed and direction of each of the first and second impellers 71 and 72 can be controlled independently to rotate in different speeds and different rotational directions. This comes in order to aid in maneuvering the apparatus backwards or forwards overcoming obstacles or slopes or climbing walls or backwashing of the filters.

These modes of operation can be applicable to any of the pool cleaning apparatuses in this specification.

The pool cleaning apparatus 10 is illustrated in FIG. 16 as including a first filter 210 and a second filter 212 that surrounds the first filter 210 and performs an additional filtering process. It is noted that the pool cleaning apparatus 10 can also include only one of these filters. The first filter 210 is coarser than the second filter 212—bigger (such as medium sized) particles can pass through the first filter 210.

The first filter 210 has a cylindrical shape and may be supported by supporting element such as spaced apart vertical bars 214. A spiral guide 42 is connected to the inner surface of the first filter 210 and, additionally or alternatively to the vertical bars 214. The first filter 210 surrounds a radially symmetrical wall 216.

The wall 216 has a lower portion that is cylindrical and has radius that is smaller than the radius of the first filter 210. The upper part of the wall 216 has a curved cross sectional view and has radial symmetry and it bridges the gap between the first filter 210 and lower part of the wall 216.

The bottom of the filtering unit 300, the first filter 210, the wall 216 and the spiral guide 42 define a first space 110 that has a spiral portion. Dirt is expected to accumulate on the inner surface of the first filter 210 and the spiral guide 42—starting from its top.

Movable flaps 21 are positioned along an annular shaped portion of the bottom of the filtering unit 300—at the bottom of the first space 110. Fluid that enters through the movable flaps 21 may follow a spiral path while being filtered by first filter 210 to provide first filtered fluid.

According to an embodiment of the invention the fluid can exit the first space 110 only through the first filter 210 and the wall 216 (that surrounds the first and second pump motors 81 and 82 and the first and second impellers 71 and 72) does not allow the fluid to pass therethrough.

According to yet another embodiment of the invention the spiral guide is coupled to the wall 216 and not to the first filter. Alternatively, spiral guides can be coupled to both the first filter 210 and to the structural element 216.

Either one of the first or second impellers 71 and 72 may be arranged to rotate along a first rotational direction and the fluid from the first space 110 to be (a) drawn through inlets formed at the bottom of the first space (via movable flaps 21), (b) to follow a spiral path within the first space 110 during which the fluid is filtered by the first filter 210 to provide first filtered fluid, (c) to enter second space 130 between the first and second filters 210 and 212, (d) to be filtered by second filter 212 to provide second filtered fluid that enters a third space 220, (e) to exit the third space 220 through openings that may be formed between the external housing and the second filter 212 and to propagate through the impellers onto the first and second fluid conduit 51 and 52 and exit the pool cleaning apparatus via the first and second outlets 61 and 62.

The first and second fluid conduits 51 and 52 are illustrated as being defined by the external housing 11, the upper shell 12, the impellers sleeve unit 312, the upper part of the wall 216 and fluid conducting tubes (not shown) that are part of the external cover 310. Fluid that passes through the first and second fluid conduits 51 and 52 interfaces with first and second impellers 71 and 72 and exits through first and second outlets 61 and 62 that also belong to the external cover 310. Especially, the impellers sleeve unit 312 includes two sleeves 311—each sleeve has a cylindrical shape and surrounds an impeller. The upper portion of each sleeve interfaces with fluid conducting tubes to form a continuous fluid path.

FIG. 22 illustrates a first uni-directional valve 222 is formed at the bottom of the external space 220 and is arranged to facilitate draining of fluid from the external space outwards at the withdrawal of the pool cleaning apparatus from the water. A second uni-directional valve 224 can be formed at the external housing, above the structural element 216 to allow the exit of air from the pool cleaning apparatus. A third uni-directional valve 226 can be provided at the bottom of the entrapment cell.

The filtering unit 300 includes a filtering unit cover 302, a filtering unit lower portion 304, the first and second filters 210 and 212, wall 216, spiral guide 42 and the filtering unit handle 309. Once the external cover 310 is removed the filtering unit 300 can be detached from the pool cleaning apparatus 10. Once removed the filtering unit 300 it exposes the propulsion module 320. A radially symmetrical inner space defined by the wall 216 surrounds the propulsion module 320.

The propulsion module 320 includes the first impeller 71, the second impeller 72, the first pump motor 81, the second pump motor 82 and the sealed housing 120.

The pool cleaning apparatus also includes side brushes 316 (see, for example, FIGS. 12-14) that extend outside the external housing and may be oriented in different angles in relation to the external housing.

LIST OF ELEMENTS a. Pool cleaning apparatus 10.
b. External housing 11.
c. Upper shell 12.
d. Brush wheels (read and front brush wheels) 13.
e. Intermediate brush 14.

f. Lower shell 15.
g. Track 16.
h. Wheels 16'.
i. Front portion (of external housing) 17.
j. Sidewalls 18.
k. Read portion (of external housing) 19.
l. Bottom panel 20.
m. Movable flap 21.
n. Inlets 22.
o. Axle 23.
p. Filter 30.
q. Wall 40.
r. Spiral guide 42.
s. First fluid conduit 51.
t. Second fluid conduit 52.
u. First outlet 61.
v. Second outlet 62.
w. First impeller 71.
x. Second impeller 72.
y. First pump motor 81.
z. Second pump motor 82.
aa. Entrapment cell 90.
bb. First input of entrapment cell 91.
cc. Filtered opening 92.
dd. Removable entrapment cell portion 93.
ee. Fluid directing elements 94.
ff. Oriented top part 95.
gg. First space 110.
hh. Sealed housing 120.
ii. Second space 130.
jj. Controller 140.
kk. Third space 150
ll. First filter 210.
mm. Second filter 212.
nn. Vertical bars 214.
oo. Wall 216.
pp. First uni-directional valve 222.
qq. Second uni-directional valve 224.
rr. Third uni-directional valve.
ss. Filtering unit 300
tt. Filtering unit cover 302
uu. Filtering unit lower portion 304
vv. Filtering unit inlets 306
ww. Filtering unit outlets 308
xx. Filtering unit handle 309.
yy. External cover 310
zz. Sleeve 311
aaa. Impeller sleeve unit 312
bbb. Side brushes 316
ccc. Propulsion module 320

In the foregoing specification, the invention has been described with reference to specific examples of embodiments of the invention. It will, however, be evident that various modifications and changes may be made therein without departing from the broader spirit and scope of the invention as set forth in the appended claims.

Moreover, the terms "front," "back," "top," "bottom," "over," "under" and the like in the description and in the claims, if any, are used for descriptive purposes and not necessarily for describing permanent relative positions. It is understood that the terms so used are interchangeable under appropriate circumstances such that the embodiments of the invention described herein are, for example, capable of operation in other orientations than those illustrated or otherwise described herein.

Although specific conductivity types or polarity of potentials have been described in the examples, it will appreciated that conductivity types and polarities of potentials may be reversed.

Those skilled in the art will recognize that the boundaries between various components are merely illustrative and that alternative embodiments may merge various components or impose an alternate decomposition of functionality upon various components. Thus, it is to be understood that the architectures depicted herein are merely exemplary, and that in fact many other architectures can be implemented which achieve the same functionality.

Any arrangement of components to achieve the same functionality is effectively "associated" such that the desired functionality is achieved. Hence, any two components herein combined to achieve a particular functionality can be seen as "associated with" Each other such that the desired functionality is achieved, irrespective of architectures or intermedial components. Likewise, any two components so associated can also be viewed as being "operably connected," or "operably coupled," to Each other to achieve the desired functionality.

Furthermore, those skilled in the art will recognize that boundaries between the above described operations merely illustrative. The multiple operations may be combined into a single operation, a single operation may be distributed in additional operations and operations may be executed at least partially overlapping in time. Moreover, alternative embodiments may include multiple instances of a particular operation, and the order of operations may be altered in various other embodiments.

However, other modifications, variations and alternatives are also possible. The specifications and drawings are, accordingly, to be regarded in an illustrative rather than in a restrictive sense.

In the claims, any reference signs placed between parentheses shall not be construed as limiting the claim. The word 'comprising' does not exclude the presence of other elements or steps then those listed in a claim. Furthermore, the terms "a" or "an," as used herein, are defined as one or more than one. Also, the use of introductory phrases such as "at least one" and "one or more" in the claims should not be construed to imply that the introduction of another claim element by the indefinite articles "a" or "an" limits any particular claim containing such introduced claim element to inventions containing only one such element, even when the same claim includes the introductory phrases "one or more" or "at least one" and indefinite articles such as "a" or "an." The same holds true for the use of definite articles. Unless stated otherwise, terms such as "first" and "second" are used to arbitrarily distinguish between the elements such terms describe. Thus, these terms are not necessarily intended to indicate temporal or other prioritization of such elements The mere fact that certain measures are recited in mutually different claims does not indicate that a combination of these measures cannot be used to advantage.

While certain features of the invention have been illustrated and described herein, many modifications, substitutions, changes, and equivalents will now occur to those of ordinary skill in the art. It is, therefore, to be understood that the appended claims are intended to cover all such modifications and changes as fall within the true spirit of the invention.

We claim:

1. A pool cleaning robot, comprising: a filter; a first impeller; a driving unit arranged to move the pool cleaning robot; an external housing that comprises a first inlet and a first outlet; a first pump motor arranged to rotate the first impeller; wherein when the first pump motor rotates the first impeller rotates along a first rotational direction causes fluid to be drawn through the first inlet and causes a first portion of the fluid to be filtered by the filter to provide filtered fluid that exits through the first outlet of the housing; wherein when the first pump motor rotates the first impeller rotates along a second rotational direction that is opposite to the first rotational direction, thereby performing a backwash operation of the filter.

2. The pool cleaning robot according to claim 1 further comprising a structural element; and wherein the filter and the structural element define a first space that has a spiral portion; wherein when the first pump motor rotates the first impeller along the first rotational direction the fluid follows a spiral path within the first space during which the first portion of the fluid is filtered by the filter.

3. The pool cleaning robot according to claim 1 further comprising a second impeller; wherein when the first impeller is rotated along the second rotational direction the second impeller is stationary.

4. The pool cleaning robot according to claim 1 further comprising a second impeller; wherein when the first impeller is rotated along the second rotational direction the second impeller rotates along the second rotational direction.

5. The pool cleaning robot according to claim 1 further comprising a second impeller and a second pump motor arranged to rotate the second impeller; wherein the controller arranged to control the first and second pump motors so that the first and second impellers are arranged to operate in at least three modes out of: a first mode during which the first and second impellers rotate about the first rotational direction and at a same speed; a second mode during which the first and second impellers rotate about the first rotational direction while one impeller of the first and second impellers rotates at a lower speed than another impeller of the first and second impellers; a third mode during which one impeller of the first and second impeller rotates about the first rotational direction at a speed that is higher than a speed of another impeller of the first and second impeller that rotates about the second rotational direction; and a fourth mode during which the first and second impellers rotates about the second rotational direction.

6. The pool cleaning robot according to claim 1 wherein the first pump motor is arranged to rotate the first impeller along the first rotational direction during a filtering period and is arranged to rotate the first impeller rotates along the second rotational direction during a backwash period; wherein the backwash period is shorter than the filtering period.

7. The pool cleaning robot according to claim 6 wherein the backwash period is less than five seconds and the filtering period exceeds a minute.

8. The pool cleaning robot according to claim 1 comprising a uni-directional valve for reducing an amount of dirt exited from the pool cleaning robot as a result of the backwash of the filter.

9. The pool cleaning robot according to claim 1 comprising a movable flap for reducing an amount of dirt exited from the pool cleaning robot as a result of the backwash of the filter.

10. The pool cleaning robot according to claim 1 further comprising an entrapment cell; wherein when the first pump motor rotates the first impeller along the first rotational direction a second portion of the fluid enters the entrapment cell; wherein the second portion of the fluid conveys particles that did not pass through the filter.

11. The pool cleaning robot according to claim 10, wherein at least some of the particles conveyed by the second portion of the fluid are too big to be filtered by the filter.

12. The pool cleaning robot according to claim 10, wherein the entrapment cell is arranged to return at least some of the second portion of the fluid to the first space.

13. The pool cleaning robot according to claim 1 further comprising a structural element; wherein the structural element comprises a wall and a spiral guide that is coupled to the wall.

14. The pool cleaning robot according to claim 13 wherein the wall comprises at least one opening that facilitates an exchange of fluid between the first space and the entrapment cell.

15. The pool cleaning robot according to claim 13, wherein the wall and the filter have a radial symmetry in relation to a vertical axis.

16. The pool cleaning robot according to claim 13 wherein the first inlet has a first movable flap that is arranged to move between an inlet closing position and a fluid directing position.

17. The pool cleaning robot according to claim 16, wherein the first movable flap, when positioned at the fluid directing position, is arranged to direct the fluid towards the spiral guide.

18. The pool cleaning robot according to claim 16, wherein the first movable flap is arranged to move to the fluid directing position due to the rotation of the first impeller along the first rotational direction.

19. The pool cleaning robot according to claim 16, wherein the first movable flap, when positioned at the inlet closing position, is arranged to prevent particles to exit the pool cleaning robot.

20. The pool cleaning robot according to claim 13, wherein the external housing comprises multiple inlets that are located between the filter and the wall; and wherein each is proximate to a movable flap; wherein the multiple inlets comprise the first inlet.

21. The pool cleaning robot according to claim 20, wherein the multiple inlets are formed within a ring shaped portion of a bottom panel of the housing, wherein the ring shape portion is delimited by the filter and the wall.

22. The pool cleaning robot according to claim 20, wherein each movable flap, when positioned at a fluid directing position, directs the fluid towards the spiral guide.

23. The pool cleaning robot according to claim 13, wherein the wall substantially surrounds the filter and wherein the filter substantially surrounds the first impeller.

24. The pool cleaning robot according to claim 13, wherein the filter substantially surrounds the wall.

25. The pool cleaning robot according to claim 13, comprising an entrapment cell that has a first opening for receiving the second portion of fluid, the first opening is at least partially defined by an upper rim of the wall.

26. The pool cleaning robot according to claim 13, comprising an entrapment cell and a fluid directing element that extends between the wall and the filter and arranged to direct fluid that reaches the end of the spiral path to enter the entrapment cell.

27. The pool cleaning robot according to claim 1, wherein the first outlet is preceded by a first fluid conduit that is arranged to guide the filtered fluid from the first impeller towards the first outlet so that the filtered fluid exits the pool cleaning robot such as to induce motion of the pool cleaning robot along a first direction.

28. The pool cleaning robot according to claim 1, wherein the housing comprises a second outlet and wherein the pool cleaning robot comprises a second impeller; wherein the second outlet is preceded by a second fluid conduit that is arranged to guide filtered fluid from the second impeller, wherein the second impeller rotates along the first rotational direction, towards the second outlet so that the filtered fluid exits the pool cleaning robot such as to induce motion of the pool cleaning robot along a second direction.

29. The pool cleaning robot according to claim 28, wherein the second direction differs from the first direction.

30. The pool cleaning robot according to claim 28, wherein each of the first and second impeller is independently controllable.

31. The pool cleaning robot according to claim 28, wherein each of the first and second impellers is located within a central segment of the pool cleaning robot, the central segment being delimited by the filter, a bottom panel of the housing and an upper shell of the housing.

32. The pool cleaning robot according to claim 1 wherein the filter has a spiral shape.

33. The pool cleaning robot according to claim 1, comprising a filtering unit that is detachably coupled to at least one other element of the pool cleaning robot, wherein the filtering unit comprises the filter, an entrapment cell and a structural element.

34. The pool cleaning robot according to claim 1, wherein the external housing comprises an external cover that is detachably coupled to an upper shell of the external housing.

35. The pool cleaning robot according to claim 34, wherein a removal of the external cover facilitates a removal of the filtering unit.

36. The pool cleaning robot according to claim 34, wherein the filtering unit comprises a first filtering unit inlet that has a first movable flap that is arranged to move between an inlet closing position and a fluid directing position.

37. The pool cleaning robot according to claim 1 comprising an entrapment cell that is configured to receive dirt resulting from the performing of the backwash operation of the filter.

38. The pool cleaning robot according to claim 37 further comprising movable flaps that are closed during the backwash operation of the filter.

* * * * *